US006375183B1

(12) United States Patent
Inoue et al.

(10) Patent No.: US 6,375,183 B1
(45) Date of Patent: Apr. 23, 2002

(54) SHEET FEEDING APPARATUS WITH INCLINED SEPARATION PLANE, AND IMAGE FORMING APPARATUS HAVING SAME

(75) Inventors: Ryukichi Inoue, Abiko (JP); Yoshihiro Matsuo, Boise, ID (US); Ryuichi Kojima, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/542,246

(22) Filed: Apr. 3, 2000

(30) Foreign Application Priority Data

Apr. 8, 1999 (JP) ..... 11-101207
Jan. 19, 2000 (JP) ..... 2000-009919

(51) Int. Cl.[7] ..... B65H 5/00

(52) U.S. Cl. ..... 271/10.11; 271/121; 271/124; 271/167

(58) Field of Search ..... 271/121, 124, 271/167, 10.11

(56) References Cited

U.S. PATENT DOCUMENTS 5,253,854 A 10/1993 Tanoue et al. ..... 271/10
5,292,116 A 3/1994 Inoue et al. ..... 271/157
5,358,230 A 10/1994 Ikemori et al. ..... 271/114
5,651,540 A 7/1997 Wantanabe et al. ..... 271/10.12
5,879,003 A * 3/1999 Kovach et al. ..... 271/121
5,907,745 A 5/1999 Azuma et al. ..... 399/92
5,927,702 A 7/1999 Ishii et al. ..... 271/9.09
6,055,407 A 4/2000 Inoue et al. ..... 399/381
6,116,589 A * 9/2000 Bortolotti ..... 271/121
6,139,007 A * 10/2000 Cahill et al. ..... 271/121
6,158,733 A * 12/2000 Muraki ..... 271/127

* cited by examiner

*Primary Examiner*—David H. Bollinger
(74) *Attorney, Agent, or Firm*—Fitzpatrick, Cella, Harper & Scinto

(57) ABSTRACT

A sheet feed roller is urged into contact with the upper surface of a sheet at the top of a stack of sheets supported on a sheet support and an inclined separation plane separates a sheet, fed forward by the sheet feed roller, from the other sheets of the stack of the sheets. A rotatable separation roller is disposed between the inclined separation plane and the sheet feed roller such that the separation roller is urged into contact with the upper surface of the sheet fed forward by the sheet feeding roller. The separation roller is movable depending on the rigidity of the sheet so that when the sheet being fed forward has low rigidity, the sheet is bent starting from a line where the sheet is in contact with the separation roller, but when the sheet being fed forward has high rigidity, the separation roller is moved upward thereby allowing the sheet is bent starting from a line where the sheet is in contact with the sheet feed roller.

31 Claims, 18 Drawing Sheets

SHEET FEEDING APPARATUS WITH INCLINED SEPARATION PLANE, AND IMAGE FORMING APPARATUS HAVING SAME

BACKGROUND OF THE INVENTION

1. Field of the Invention

The present invention relates to a sheet feeding apparatus used in an image forming apparatus to feed sheets one by one from a stack of sheets.

2. Description of the Related Art

In the art of sheet feeding apparatus used in image forming apparatus such as printers and copying machines, it is known to use an inclined separation plane to separate a sheet. In this type of sheet feeding apparatus, a sheet is moved against an inclined separation plane by rotating a sheet feed roller in contact with the top of a stack of sheets so that a sheet on the top is separated from the other sheets.

The advantage of the sheet feeding apparatus of the inclined plane separation type is that it has a simple structure because it does not need complicated separation means such as a separation pad and a reversing roller, or a mechanism for maintaining a sheet at a particular height such as a lifting mechanism or a pressure plate urged by a spring.

Although the sheet feeding apparatus of the inclined plane separation type is capable of separating sheets with a thickness and rigidity within certain ranges, it is difficult for this type of sheet feeding apparatus to handle very thin sheets or sheets with very low rigidity. When sheets are very thin, they often bend, and a separation failure often occurs. Thus, a feeding error often occurs in which a plurality of sheets are fed at a time. One technique to solve the above problem is to dispose the sheet feed roller in the vicinity of the inclined separation plane so that a sheet is sharply curved between the inclined separation plane and the sheet feed roller, thereby enhancing the separation ability and preventing a plurality of sheets from being fed at a time. However, in this technique, when a sheet has very large rigidity as is the case with a very thick sheet, the sheet stops when it comes into contact with the inclined separation plane, because such a sheet is not easily bent.

When sheets curl at their leading end, there is a high possibility that a plurality of sheets will be fed at a time or that other feeding failures will occur.

SUMMARY OF THE INVENTION

In view of the above, it is an object of the present invention to provide a sheet feeding apparatus of the inclined plane separation type capable of separating and feeding sheets in a highly reliable fashion regardless of the thickness and rigidity of sheets and regardless of whether the sheets curl at their leading end.

According to an aspect of the present invention, there is provided a sheet feeding apparatus comprising sheet supporting means for supporting a stack of sheets; a sheet feed roller, in contact with the upper surface of a sheet at the top of the stack of sheets supported by the sheet supporting means, for feeding the sheet; an inclined separation plane for separating the sheet fed by the sheet feed roller from the other sheets; a rotatable separation roller, disposed between the inclined separation plane and the sheet feed roller, for pressing the upper surface of the sheet fed by the sheet feed roller; and roller supporting means for movably supporting the separation roller.

In accordance with yet another aspect of the present invention, there is provided a sheet feeding apparatus as described above wherein the rotatable separation roller is movable in accordance with the rigidity of the sheet being fed.

In accordance with yet another aspect of Applicants' invention there is provided a sheet feeding apparatus comprising sheet supporting means for supporting a stack of sheets, sheet feeding means for feeding the sheets, an incline separation plane and a rotatable separation roller, all as described above. In accordance with this aspect of the invention, there is further provided switching means for switching the separation roller between a position in which the separation roller presses the upper surface of the sheet being fed and a position in which the separation roller is apart form the upper surface of the sheet being fed, wherein the switching means automatically switches the position of the separation roller depending on the rigidity of the sheet which is fed by the sheet feeding means and bent by the inclined separation plane.

In accordance with yet another aspect of the present invention there is provided an image forming apparatus which includes a sheet feeding apparatus as described above in combination with image forming means for forming an image on the sheet separated by the inclined separation plane.

DESCRIPTION OF THE PREFERRED EMBODIMENTS

Figure 1:
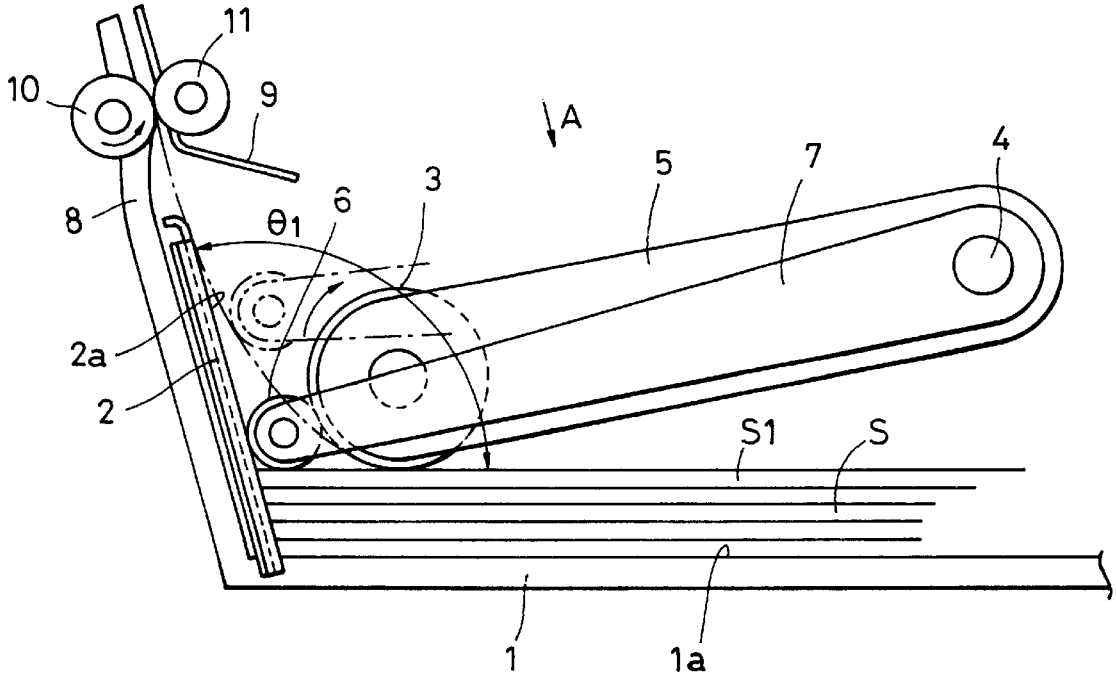
FIG. 1 is a sectional view of a first embodiment of a sheet feeding apparatus according to the present invention.

FIG. 1 is a cross-sectional view of an embodiment of a sheet feeding apparatus according to the present invention, wherein the apparatus is in a feed-ready state.

As shown in FIG. 1, the sheet feeding apparatus includes a sheet supporting member 1 serving as sheet supporting means having a surface 1*a* on which sheets are placed; an inclined-plane 2*a* for separating member 2 having an inclined separation plane 2*a* for separating one sheet S1 at the top of the stack of sheets S from the other sheets of the stack placed on the sheet-placing surface 1*a*; a sheet feed roller 3, in contact with the upper surface of a sheet at the top of the stack of sheets placed on the sheet-placing surface 1*a*, for feeding a sheet; a driving shaft 4 for transmitting a driving force to the sheet feed roller 3; and a sheet feed roller arm (L) 5, pivotable about the driving shaft, for holding the sheet feed roller 3.

The sheet feeding apparatus further includes a separation roller (L) 6 in contact with the leading end of the stack of sheets placed; a separation roller arm (L) 7 serving as roller supporting means which holds the separation roller (L) 6 in a rotatable fashion and which is pivotably held by the driving shaft 4; a lower guide 8 for guiding a sheet which has arrived after travelling along the inclined separation plane 2*a* of the inclined-plane separating member 2; an upper guide 9 for guiding the upper side of the sheet; a transport roller 10 which rotates in a direction denoted by an arrow in the figure; and a transport roller 11 which is rotatably held and urged by urging means (not shown) against the transport roller 10.

Figure 2:
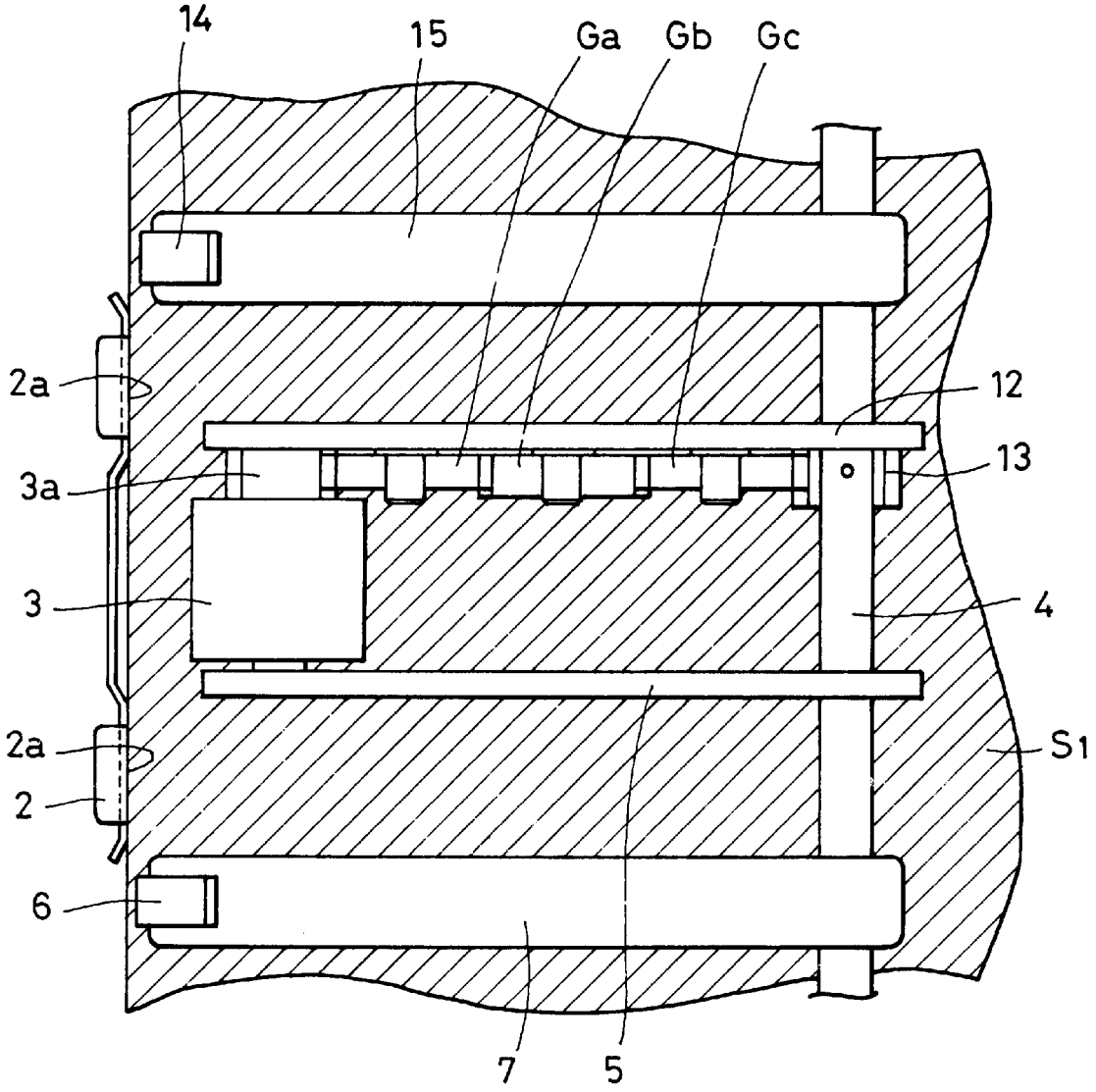
FIG. 2 is a view of the sheet feeding apparatus seen from a direction denoted by an arrow A shown in FIG. 1.

FIG. 2 is a schematic diagram of the sheet feeding apparatus viewed in a direction denoted by an arrow A in FIG. 1. In FIG. 2, a roller driving gear 3*a* is integrally formed with the sheet feed roller 3. A sheet roller arm (R) 12 is similar, in external shape and hole position, to the sheet roller arm (L) 5. The sheet roller arm (R) 12 rotatably holds the shafts of the respective gears Ga, Gb, and Gc of the idler gear train. A driving gear 13 is fixed to the driving shaft 4, wherein, in the state shown in FIG. 2, the driving gear 13 meshes with the idler gear Gc. Reference numeral 14 denotes a separation roller (R), and reference numeral 15 denotes a separation roller arm (R) forming roller supporting means. The separation roller (R) 14 and the separation arm (R) 15 are similar in external shape and structure to the separation roller (L) 6 and the separation roller arm (L) 7, respectively.

The operation of the sheet feeding apparatus having the above construction is described below.

Under the control of a driving controller (not shown), a driving force is transmitted from a driving source such as a motor (not shown) to the driving shaft 4. As a result, the driving shaft 4 rotates, and the rotation is transmitted to the roller driving gear 3*a* via the idler gears Ga, Gb, and Gc. As a result, the sheet feed roller 3 rotates. A frictional force arising from the rotation of the sheet feed roller 3 is applied to a sheet S1 at the top of the stack of sheets S supported on the sheet supporting member 1, and thus the sheet S1 attempts to move. However, the motion of the sheet S1 is restricted by the inclined separation plane 2*a*. As a result, the sheet S1 is deformed (bent).

Herein, the sheet S1 is pressed by the separation roller (L) 6 and the separation roller (R) 14. Therefore, if the sheet S1 has low rigidity as is the case with a thin sheet, the sheet S1 having low rigidity is deformed starting from a line in contact with the separation rollers 6 and 14. Although the separation rollers 6 and 14 can be lifted depending on the rigidity of the sheet, the deformation always starts from the line in contact with the separation rollers 6 and 14. Thus, the sheet having low rigidity is sharply bent between the inclined separation plane 2*a* and the separation rollers 6 and 14, and the sheet being fed presses a next sheet between it and the inclined separation plane 2*a*. As a result, the sheet is separated in a highly reliable fashion.

Because the separation rollers 6 and 14 rotate smoothly, the sheet S1 is transported to a nip between the transport roller 10 and the transport roller 11 while maintaining the bending start line at the line in contact with the separation rollers 6 and 14.

When a sheet with high rigidity such as thick paper is fed, the separation rollers 6 and 14 and the separation roller arms 7 and 15 are pushed upward by the sheet. The upward position is represented by a two-dot chain line in FIG. 1. The sheet is bent starting not at the line in contact with the separation rollers 6 and 14 but at a line in contact with the sheet feed roller 3. Thus, the sheet S1 is transported to the nip between the transport roller 10 and the transport roller 11 while lifting the separation rollers 6 and 14. In the case of sheets with high rigidity, as described above, the separation rollers 6 and 14 are lifted by a sheet being fed and thus the sheet being fed is gradually bent between the inclined separation plane 2*a* and the sheet feed roller 3. That is, in the case of sheets with high rigidity, unlike sheets with low rigidity which are bent abruptly at the location of the separation rollers 6 and 14, the sheet being fed are bent into a gradually curved form which prevents the sheet from being stopped by contact with the inclined separation plane 2*a*. Thus, the sheet is fed without encountering a feeding failure.

In the mechanism formed by the sheet feed roller 3, the sheet roller arms 5 and 12 employed in the present embodiment, a reaction force against the friction applied from the sheet feed roller 3 to the sheet causes the sheet roller arms 5 and 12 to have a rotation moment which in turn causes the sheet feed roller 3 to be urged into contact with the sheet. As a result, the pressure imposed by the sheet feed roller 3 upon the sheet S1 automatically increases, and the sheet S1 is pushed by the sheet feed roller 3 toward the inclined separation plane 2*a*. Thus, the ability to feed the sheet S1 is enhanced.

Therefore, also in the case where thick paper is fed, the sheet S1 can be transported to the nip between the transport roller 9 and the transport roller 10 while lifting the separation rollers 6 and 14. After that, the sheet S1 is further transferred to an image forming part by means of transporting force imposed by the pair of transport rollers 10 and 11 upon the sheet S 2.

The sheet feeding apparatus constructed in the above-described manner has the following advantages.

Sheets with low rigidity can be separated and fed in a highly reliable fashion without encountering a feeding error in which a plurality of sheets are fed at a time. Furthermore, sheets with high rigidity can also be separated and fed in a highly reliable fashion without encountering a feeding failure.

Furthermore, because the rotatable roller is employed as the member for pressing the upper surface of the end part of the stack of sheets, the resistance force imposed on the sheet and resisting the motion of the sheet can be minimized. Another advantage of the rotatable roller is that the surface of the sheet is not damaged. Furthermore, it becomes possible to form a contacting line of the member for pressing the upper surface of the sheet at a location closer to the inclined separation plane than can be by the conventional techniques, thereby preventing a plurality of sheets from being fed at a time in a more reliable fashion.

Although in the present embodiment, the sheet feed roller 3, the sheet separation roller (L) 6, and the sheet separation roller (R) 14 are urged by their own weight into contact with the stack of sheets, urging may also be achieved using urging means such as a torsion coil spring. Furthermore, the sheet feed roller 3, the sheet separation roller (L) 6, and the sheet separation roller (R) 14 may be urged upward by urging means so as to obtain a smaller total effective contacting pressure.

In the present embodiment, three idler gears are used to transmit the driving force from the driving shaft to the sheet feed roller 3 thereby applying a rotation moment which attempts to move the sheet feed roller 3 away from the sheet. Alternatively, an even number of idler gears may be used to apply a rotation moment which results in an increase in the pressure imposed by the sheet feed roller against the sheet.

Second Embodiment

Figure 3:
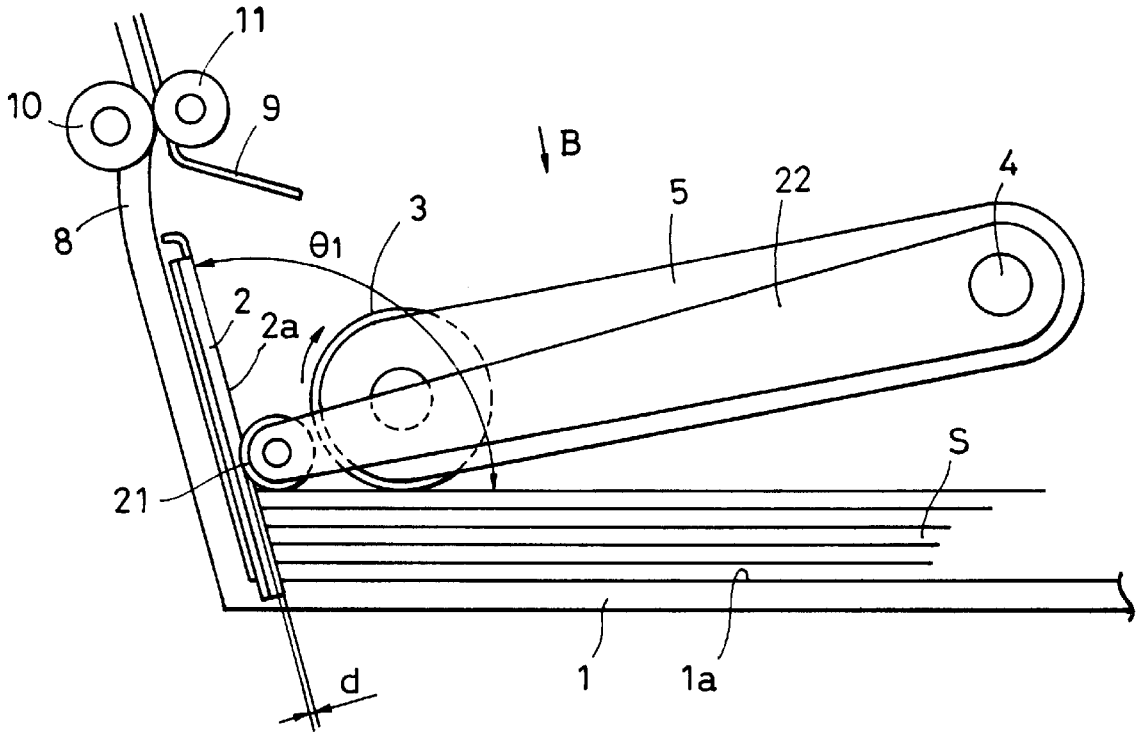
FIG. 3 is a sectional view of a second embodiment of a sheet feeding apparatus according to the present invention.
Figure 4:
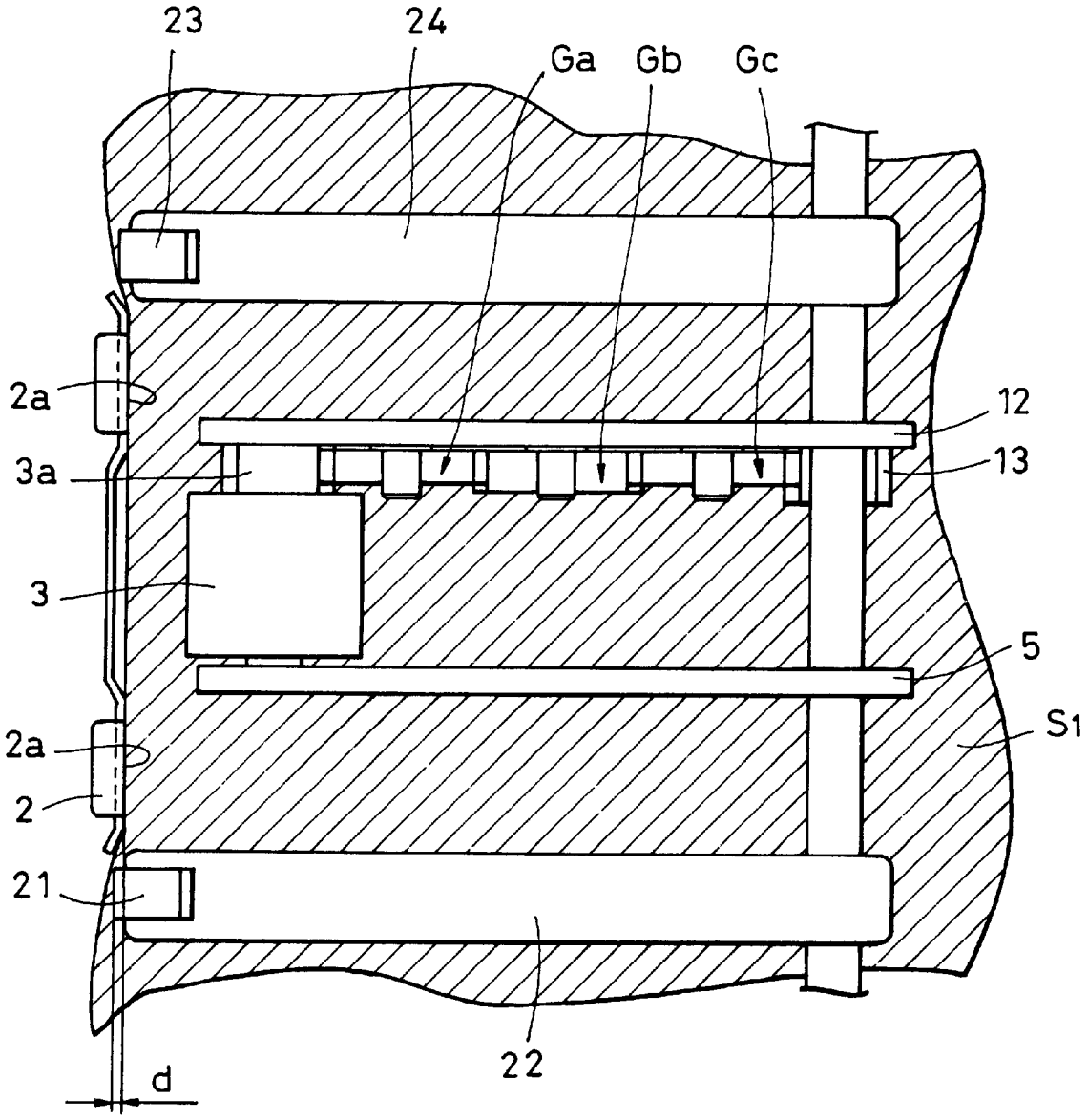
FIG. 4 is a view of the sheet feeding apparatus seen from a direction denoted by an arrow B shown in FIG. 3.

FIGS. 3 and 4 illustrate a second embodiment of the present invention, wherein members corresponding to those in the first embodiment are denoted by the same reference numerals. In these figures, reference numeral 21 denotes a separation roller (L), 22 denotes a separation roller arm (L), 23 denotes a separation roller (R), and 24 denotes a separation roller arm (R).

The second embodiment is characterized in that, as can be seen from the cross-sectional view in FIG. 3 and from FIG. 4 illustrating the view seen in a direction denoted by an arrow B shown in FIG. 3, the locations of the separation rollers 21 and 23 are shifted in a direction opposite to the sheet feed roller 3 from locations at which the ends of the separation rollers 21 and 23 would be in a plane spanned by the inclined separation plane (sheet-contacting surface) 2*a* of the inclined-plane separating member 2. This arrangement does not result in interference between the inclined separation plane and the separation rollers 21 and 23 when the separation rollers 21 and 23 rotate, because the locations of the separation rollers 21 and 23 with respect to a direction across the width of the stack of sheets are outside the width of the inclined separation plane 2*a*.

When thick paper is fed, the separation rollers 21 and 23 are lifted by the sheet, and thus the feeding operation is similar to that in the first embodiment. In the case where thin paper is fed, when the leading end of the sheet S1 comes under the separation rollers 21 and 23, the sheet is deformed or bent in a two-dimensional fashion (in both directions—along the traveling direction of the sheet and along the width of the sheet) as shown in FIG. 4, as opposed to the first embodiment in which the sheet is bent in a manner in which one end of the sheet is fixed and the other end is free. The deformation results from a strong force applied by the sheet feed roller 3 to the sheet S1 at the top of the stack of sheets. However, the sheets under the top sheet are not deformed because only a weak frictional force is imposed upon them. This allows sheets with small rigidity to be separated in a more reliable fashion, than in the first embodiment, without causing a plurality of sheets to be fed at the same time. The features specific to the second embodiments are as follows.

It is possible to prevent a plurality of sheets with low rigidity from being fed at a time in a more reliable fashion. Use of rotatable separation rollers as sheet-contacting members results in a reduction in the back tension during the sheet feeding operation. Resistance which occurs when thick paper is fed is minimized and thus it is possible to handle sheets with greater thicknesses.

Third Embodiment

Figure 5:
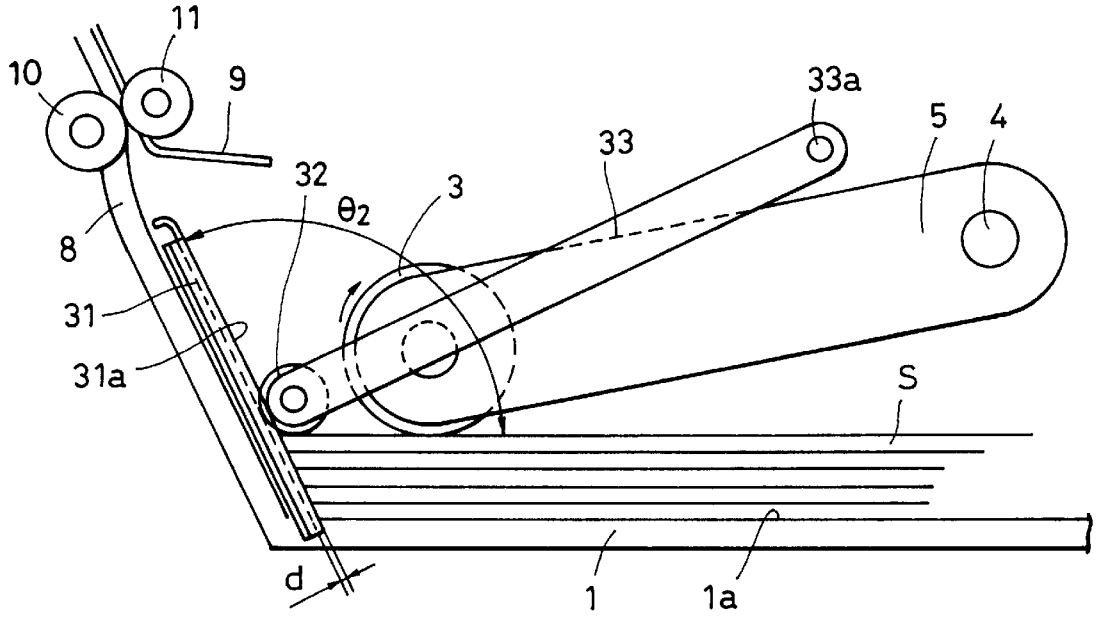
FIG. 5 is a sectional view of a third embodiment of a sheet feeding apparatus according to the present invention.

FIG. 5 illustrates a third embodiment of the present invention, wherein similar members to those in the first embodiment are denoted by similar reference numerals. In FIG. 5, reference numeral 31 denotes an inclined-plane separation member having an inclined separation plane 31*a*. The inclined-plane separation member 31 is disposed such that the inclined separation plane 31*a* is inclined at an angle of $\theta 2$ ($>\theta 1$) with respect to the plane of the sheet S. Reference numeral 32 denotes a separation roller, 33 denotes a separation roller arm, and 34 denotes a shaft for pivotably holding the separation roller arm 33. As for the separation rollers, as in the first and second embodiments, a pair of separation rollers is used.

The sheet feeding operation of the third embodiment is similar to that in the first and second embodiments. In this embodiment, the angle $\theta 2$ of the inclined separation plane 31*a* with respect to the sheet plane is set to a value greater than the angle $\theta 1$ employed in the first and second embodiments so that thick paper can be fed more easily. However, for thin paper, the greater angle $\theta 2$ results in a greater possibility that a plurality of sheets are fed at the same time. To solve this problem, separation rollers 32 are also used in the present embodiment.

The features specific to the present embodiment are as follows. Thicker paper having greater rigidity can be fed by setting the angle between the inclined separation plane 31*a* and the sheet plane to a greater value. In this case, because the location of the rotating shaft 4 of the sheet feed roller arm 5 is limited by the coefficient of friction of rubber, it is undesirable to use the rotating shaft 4 as a shaft for supporting the separation roller arm 5, because the relative location between the separation roller 32 and the inclined separation plane 31*a* greatly varies depending on the height of the stack of sheets. In the present embodiment, in view of the above, the supporting shaft 33*a* of the separation roller arm 33 is disposed at an optimum location depending on the angle of the inclined separation plane thereby optimizing the location of the rotation center of the separation roller arm 33 and the length of the separation roller arm 33. Furthermore, it becomes possible to reduce the force imposed upon the rotating shaft when the sheet feed roller 3 is driven.

Fourth Embodiment

Figure 6:
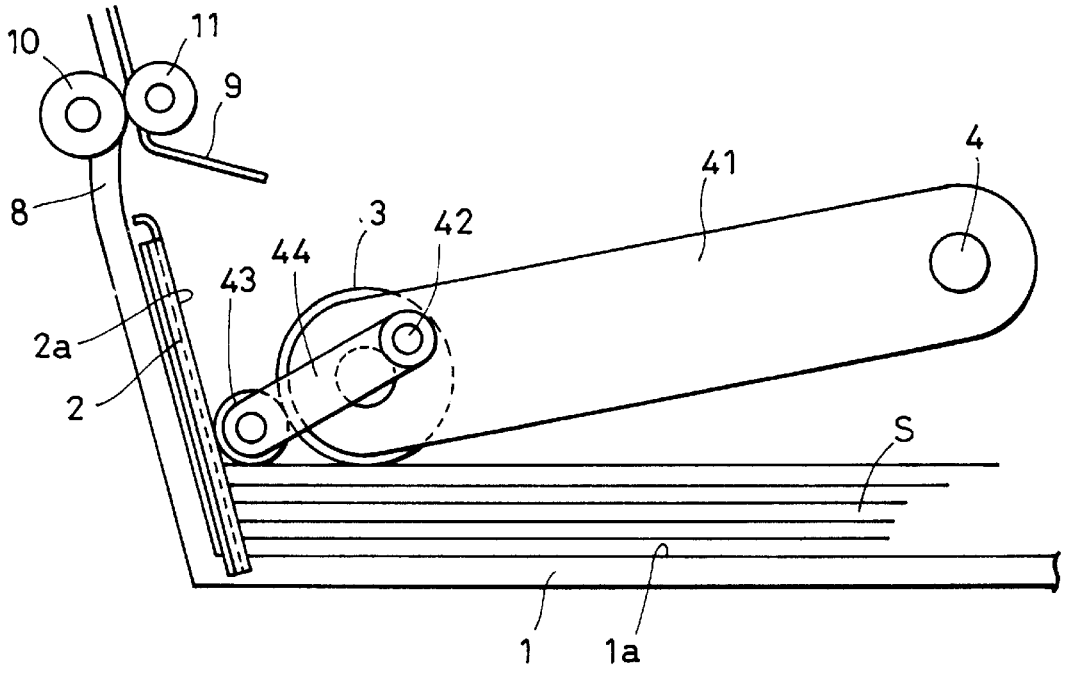
FIG. 6 is a sectional view of a fourth embodiment of a sheet feeding apparatus according to the present invention, wherein the sheet feeding apparatus is in a ready state.
Figure 7:
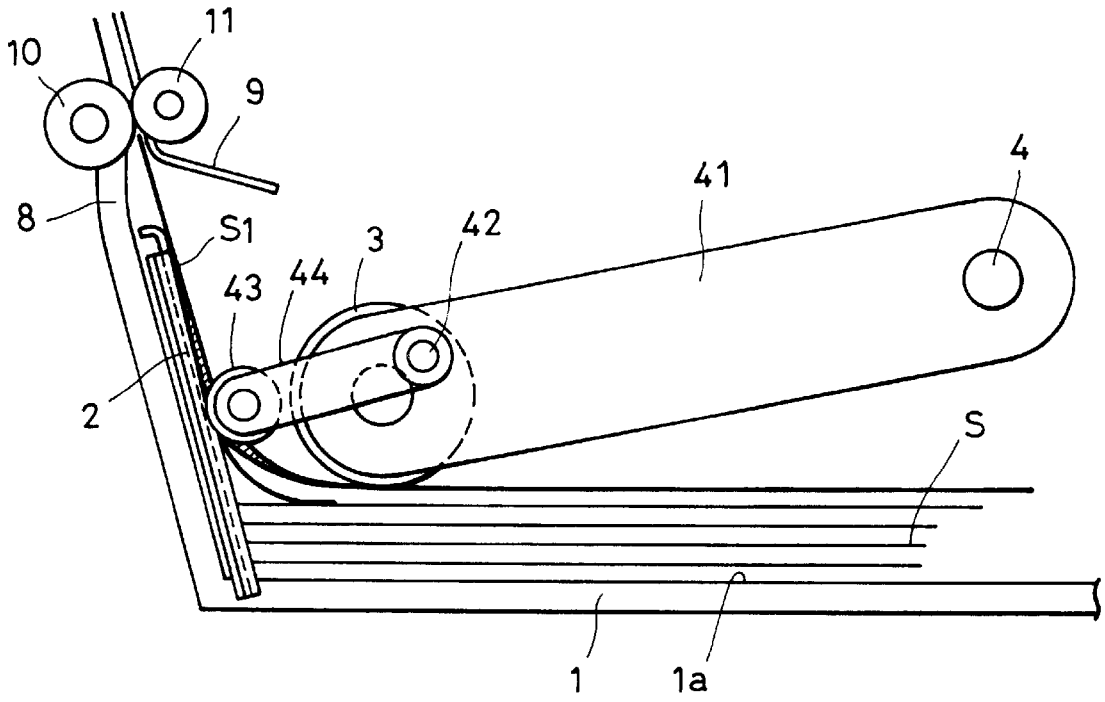
FIG. 7 is a sectional view of the fourth embodiment of the sheet feeding apparatus according to the present invention, wherein the sheet feeding apparatus is in operation.

FIGS. 6 and 7 illustrate a fourth embodiment of the present invention, wherein members corresponding to those in the first embodiment are denoted by the same reference numerals. In these figures, reference numeral 41 denotes a sheet feed roller arm, 42 denotes a shaft of the sheet feed roller arm 41, 43 denotes a separation roller, and 44 denotes a separation roller arm whose one end is pivotably held by the shaft 42 and which holds the separation roller 43 at the other end. Although not shown in the figures, there is another set of a sheet feed roller arm 41, a shaft 42, a separation roller 43, and a separation roller arm 44, wherein one set is located on the right side and the other set is located on the left side in a symmetrical fashion.

FIG. 6 illustrates a state before starting a sheet feeding operation, and FIG. 7 illustrates a state after starting the sheet feeding operation. In FIG. 7, a hatched area represents a part of the sheet S1 bent across its width. The sheet feeding operation in the fourth embodiment is similar to that in the second embodiment, and thus it is not described in further detail here.

The features specific to the present embodiment are as follows.

The separation rollers 43 are located at substantially fixed positions with respect to the inclined separation plane regardless of the number of sheets of the stack of sheets. Because, the angle of the separation roller arms 44 does not greatly vary when the number of stacked sheets varies, the variation in the contacting pressure can be minimized even when the separation roller is urged against the sheets using urging means such as a spring.

Fifth Embodiment

FIGS. 8 to 11 illustrate a fifth embodiment of the present invention. This embodiment has two features: (1) No separation roller holder is used; and (2) A release mechanism for moving a separation roller and a sheet feed roller from a sheet is used.

Figure 8:
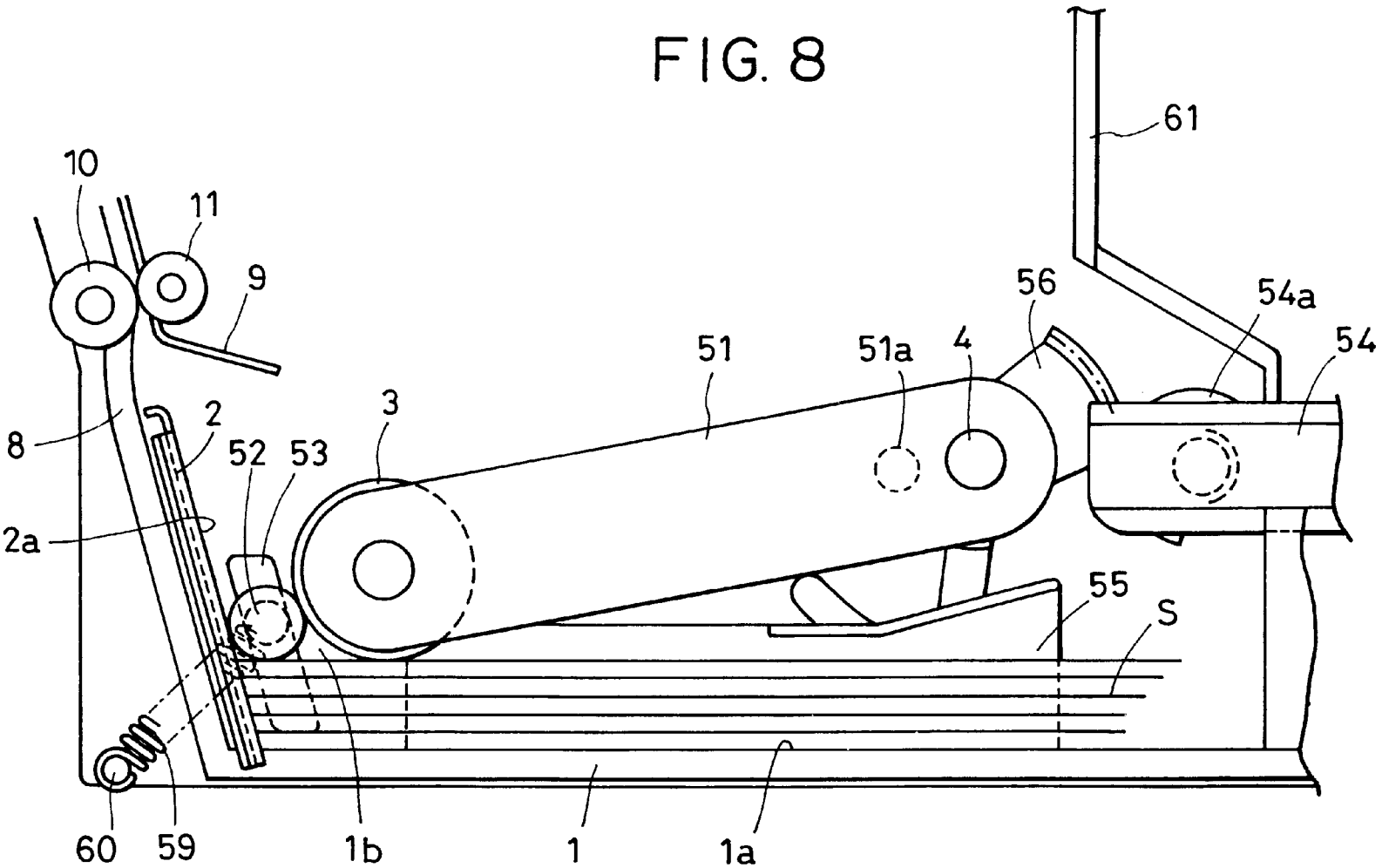
FIG. 8 is a sectional view of a fifth embodiment of a sheet feeding apparatus according to the present invention, wherein the sheet feeding apparatus is in a ready state.
Figure 9:
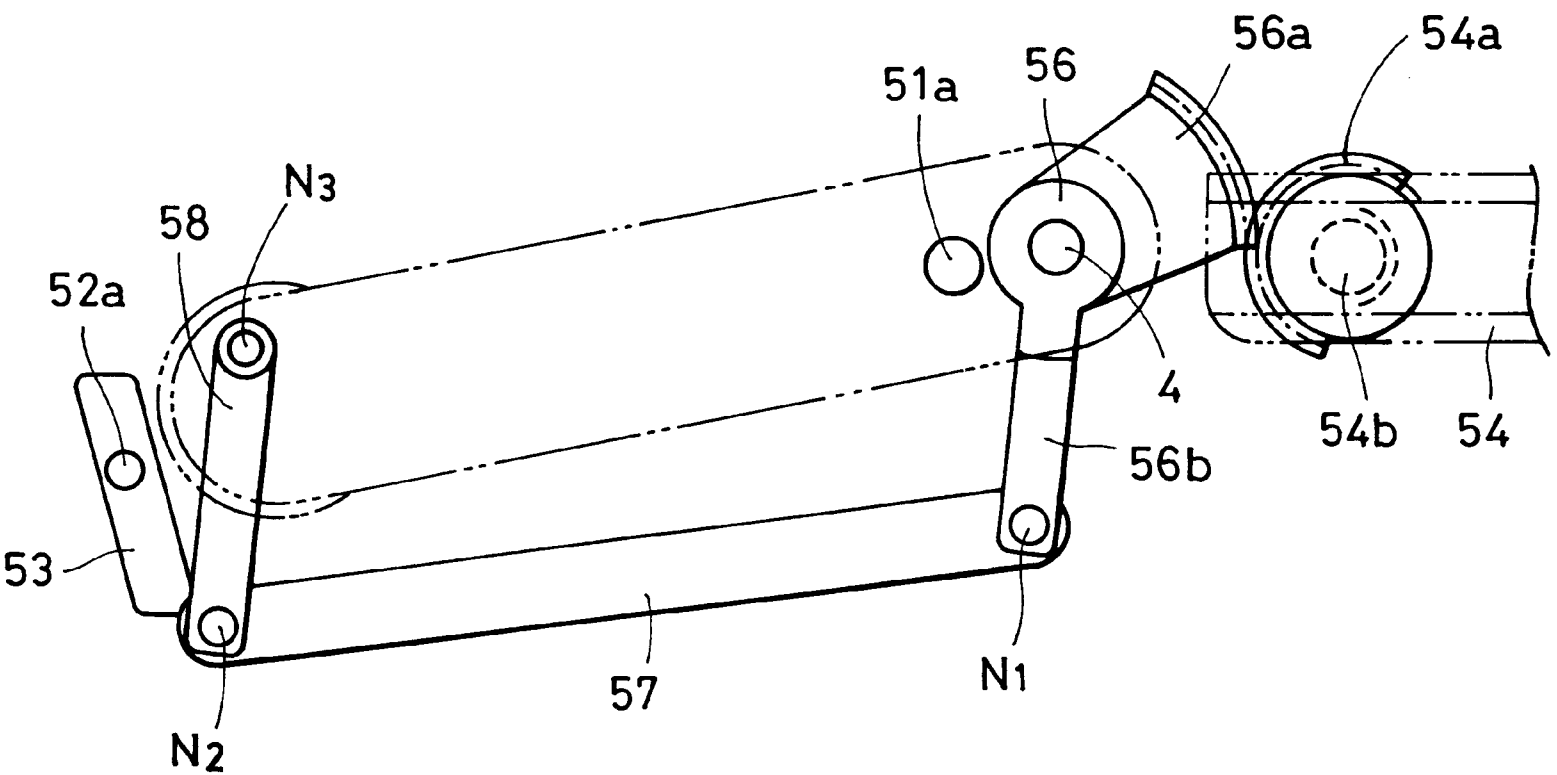
FIG. 9 is a schematic diagram illustrating a separation cam release mechanism of the sheet feeding apparatus according to the fifth embodiment of the present invention, wherein the separation cam release mechanism is in a ready state.
Figure 10:
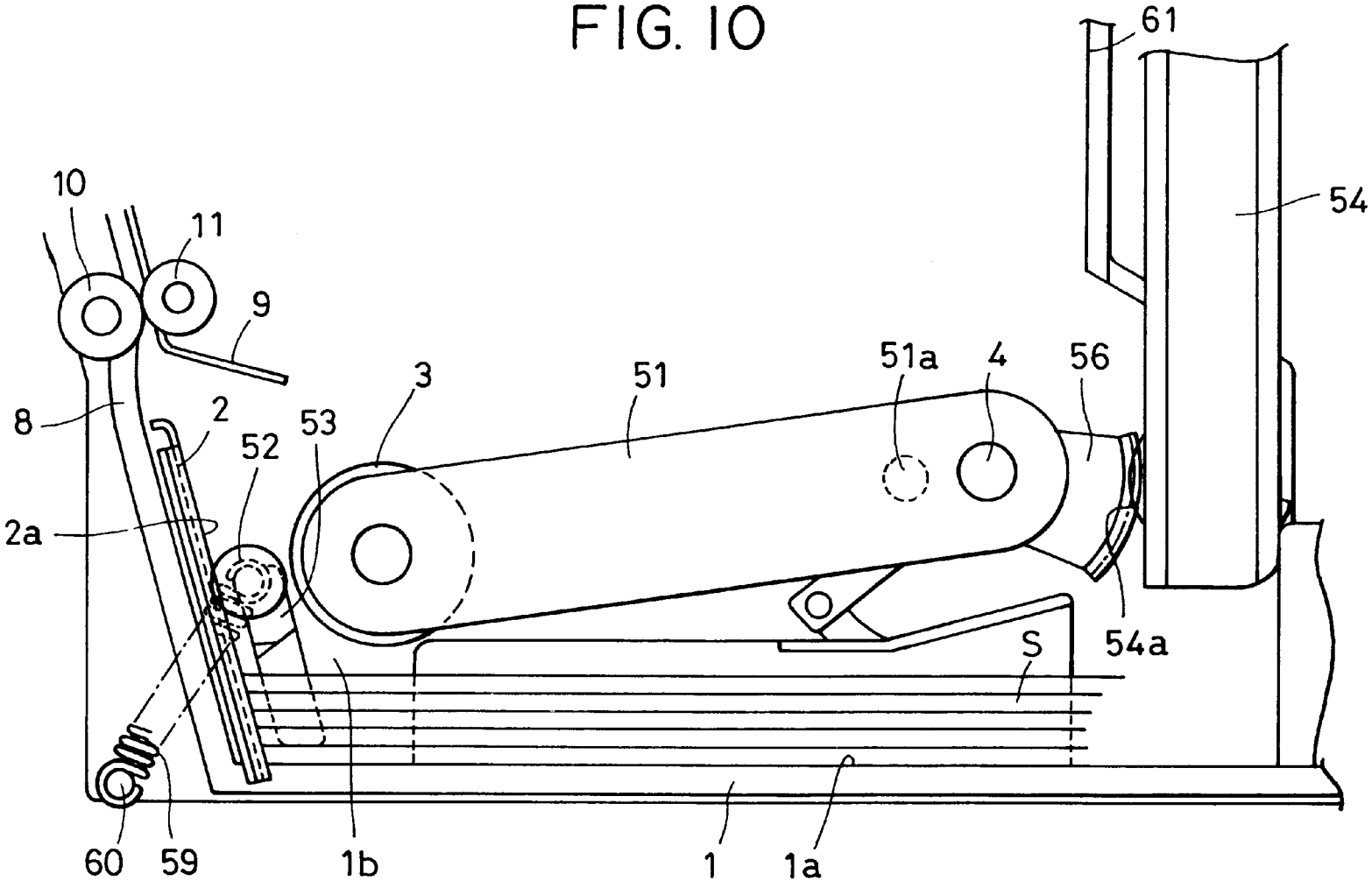
FIG. 10 is a principal sectional view of the fifth embodiment of the sheet feeding apparatus according to the present invention, wherein the sheet feeding apparatus is in a state in which sheets are being replenished.
Figure 11:
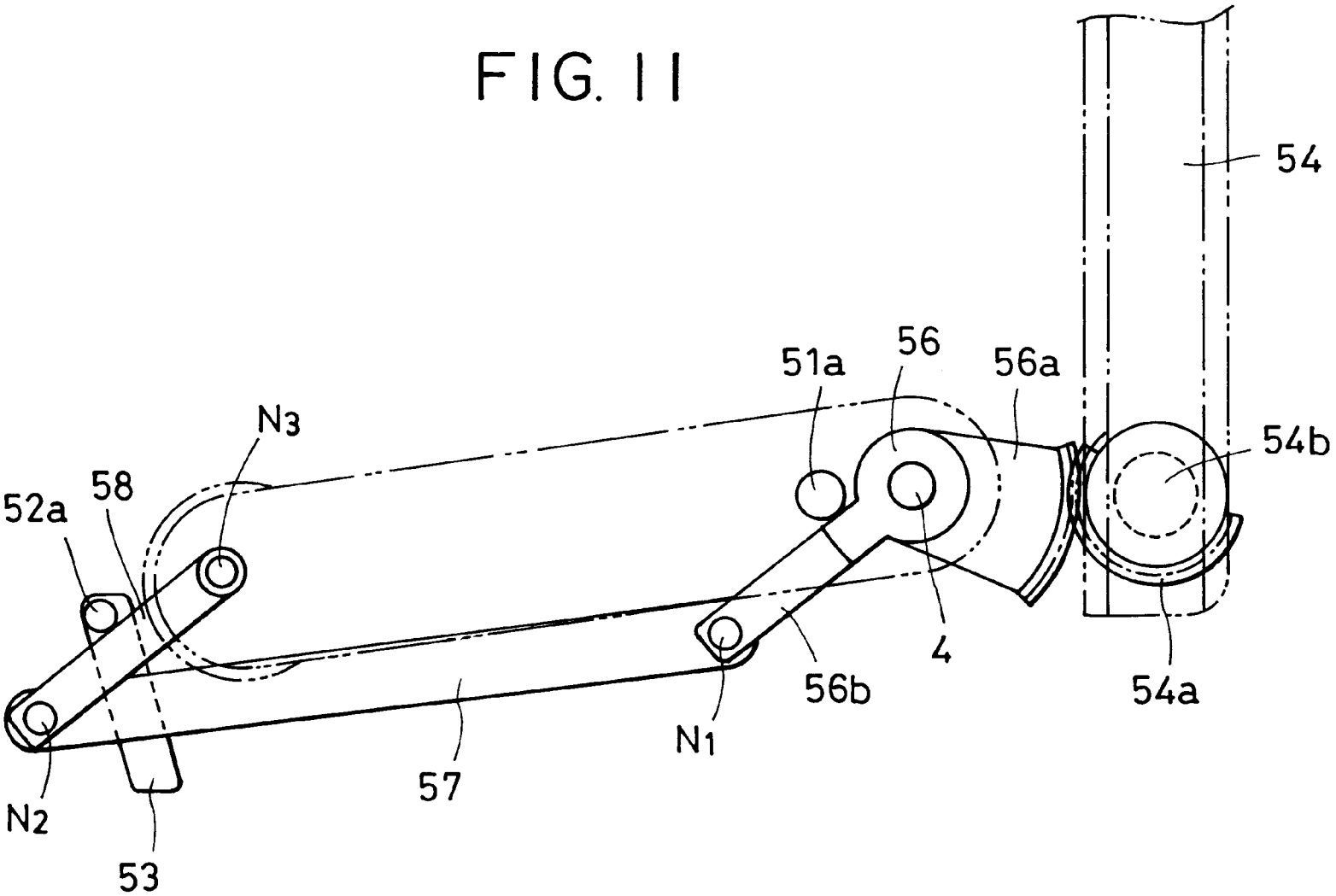
FIG. 11 is a schematic diagram illustrating the separation cam release mechanism of the sheet feeding apparatus according to the fifth embodiment of the present invention, wherein the separation cam release mechanism is in a state in which sheets are replenished.

FIG. 8 illustrates a sheet feeding apparatus of the present embodiment in a feeding-ready state. FIG. 9 illustrates the release mechanism in the state shown in FIG. 8. FIG. 10 illustrates a state in which a sheet tray cover is opened to replenish sheets. Herein, the separation roller and the sheet feed roller are moved upward by the release mechanism into a state in which engagement between the sheet and the nip is released. FIG. 11 illustrates the release mechanism in the state shown in FIG. 10. In these figures, similar members to those in the first embodiment are denoted by similar reference numerals.

In FIGS. 8 and 9, reference numeral 51 denotes a sheet feed roller arm, and 52 denotes a separation roller. The separation roller extends in a direction across the width of the sheet feeding apparatus of the present embodiment, wherein the separation roller enters the walls (side walls) on both ends of the sheet supporting member 1 from their inner surface 1*b*, passes through the side walls, and further extends toward the outside. A protruding part of the separation roller is denoted by reference numeral 52*a*. Reference numeral 53 denotes an opening which is formed in the side wall such that the protruding part 52*a* passes through the opening 53. The opening 53 is formed in a shape elongated in a direction along the inclined separation plane 2*a*.

Reference numeral 54 denotes a cover for protecting the upper surface of a part of the stack of the sheets S extending outward beyond an outer frame 61 of the main body of the image forming apparatus. Reference numeral 54*a* denotes a gear fixed to the cover 54. Reference numeral 54*b* denotes a rotatable shaft of the cover 54. Reference numeral 55 is a side position limiter for limiting the position of the side edge of the stack of sheets S. Reference numeral 56 denotes a gear arm held by the driving shaft 4.

Reference numeral 56*a* denotes a gear meshing with the gear 54*a*. Reference numeral 56*b* denotes an arm serving as a link. The gear 56*a* and the arm 56*b* are formed in an integral fashion or fixed to each other. Reference numeral 57 denotes a rod having linking nodes N1 and N2 at both ends. Reference numeral 58 denotes a separation roller release arm one end of which is pivotably supported by the frame of the sheet feeding apparatus through N3 and the other end is rotatably connected to the rod 57 through the node N2. Reference numeral 59 denotes a tension spring one end of which is held by the protruding part 52*a* of the of the separation roller 52 and the other end of which is held by a supporting pin 60 so that the separation roller 52 is pulled by the tension spring 59 in a direction toward the bottom and left in FIG. 8, that is in a direction which causes the separation roller 52 to be urged against both the inclined separation plane 2*a* of the inclined-plane separation member 2 and the stack of sheets S.

The sheet feeding operation of the sheet feeding apparatus having the above-described structure is similar to that in the first embodiment, and thus it is not described in further detail here.

The operation of the release mechanism performed when sheets are replenished is described below. When the sheet feeding apparatus is in a standby state or in operation, the release mechanism is in a state such as that shown in FIG. 9. In this state, the sheet feed roller arm 51 and the separation roller 52 are urged by their own weight or urging means (not shown) into contact with the stack of sheet S and the inclined separation plane 2*a* of the inclined-plane separation member 2, respectively.

If a user turns the cover 54 in a counterclockwise direction in FIG. 8 to replenish sheets, the gear 54*a* integrally connected with the cover 54 rotates. The rotation of the gear 54*a* causes the gear 56*a* of the gear arm 56 meshing with the gear 54*a* to rotate, and the 4-node linking mechanism composed of the arm 56*b*, the rod 57, and the separation roller release arm 58 operates. As a result, the release mechanism comes into a state shown in FIG. 11. In this state, as shown in FIG. 10, the sheet feed roller arm 51 and the separation roller 52 are moved into positions higher than the height of the stack of sheets so that the user can easily replenish sheets.

The features specific to the present embodiments are as follows.

The movable range of the separation roller 52 can be arbitrarily set. This allows the space between the separation roller 52 and the inclined separation plane to be optimized depending on the number of sheets stacked on the sheet tray thereby ensuring higher reliability in a sheet feeding operation. Because the separation roller 52 can be disposed so that it is in contact with both the inclined separation plane 2*a* and the stack of sheets, it is possible to reduce the diameter of the separation roller 52 thereby allowing a thin sheet to be bent more sharply and thus making it possible to feed the sheet in a further reliable fashion without encountering a feeding error in which a plurality of sheets are fed at a time.

Although in the present embodiment, the sheet feed roller and the separation roller are moved away from the sheet at the top of the stack of sheets when the cover is opened to replenish sheets, the sheet feed roller and the separation roller may also be moved away when an operation lever or the like is operated. Furthermore, the sheet supporting member may also be constructed in the form of a cassette that is attachable/removable to/from the main body of the apparatus such that the sheet feed roller and the separation roller are moved away from a top sheet when a lock of the cassette is released into a state in which the cassette is allowed to be drawn.

Sixth Embodiment

A sixth embodiment of a sheet feeding apparatus 102 according to the present invention is described below referring to FIG. 12.

The sheet feeding apparatus 102 includes an automatic sheet feeder 114 for feeding sheets one by one from a stack of sheets and also includes a sheet tray unit 115 on which the stack of sheets is placed. The automatic sheet feeder 114 includes a sheet feeding unit 116 and a transport part 117.

The sheet feeding unit 116 includes a sheet feed roller 118 which rotates together with a sheet feeding gear 118*a*, an idler gear (A) 119 meshing with the sheet feeding gear 118*a*, an idler gear (B) 120 meshing with the idler gear (A) 119, a driving gear 121 meshing with the idler gear (B) 120, a driving gear 122 attached to the driving gear such that it is rotatable together with the driving gear 121, and a sheet feed roller holder 123 which rotatably supports the sheet feed roller 118, the idler gear A 119, the idler gear B 120, and the driving gear 121 and which is pivotably attached to the driving shaft 122. A driving force is generated by a driving source such as a motor (not shown) and transmitted to the driving shaft 122, and rotation of the driving shaft 122 is transmitted to the sheet feed roller 118 via the gears 21, 20, 19, and 18*a*. The rotation of the sheet feeding roller 118 causes a sheet to be fed.

The sheet feed roller 118 is urged into contact with the sheet by the weight of the gears 118*a*, 119, 120, and 121, the weight of sheet feeding roller holder 123, and the weight of the sheet feed roller 118 itself. Additional urging means such as a spring may be used to urge the sheet feed roller 118 into contact with the sheet.

An inclined separation plane 133 is provided on the sheet tray unit 115 so that a sheet fed by the sheet feed roller 118 is separated from the other sheets by the inclined separation plane 133. As will be described in further detail later, the sheet fed by the sheet feed roller 118 from the sheet tray unit 115 is bent by the inclined separation plane 133 and transported along the inclined separation plane 133.

A separation roller 124 is disposed between the inclined separation plane 133 and the sheet feed roller 118 such that the separation roller 124 is in contact with the leading end of the stack of sheet. The separation roller 124 is rotatably held by the separation roller arm 125 at its end. The other end of the separation roller arm 125 is pivotably supported by the driving shaft 122.

Figure 12:
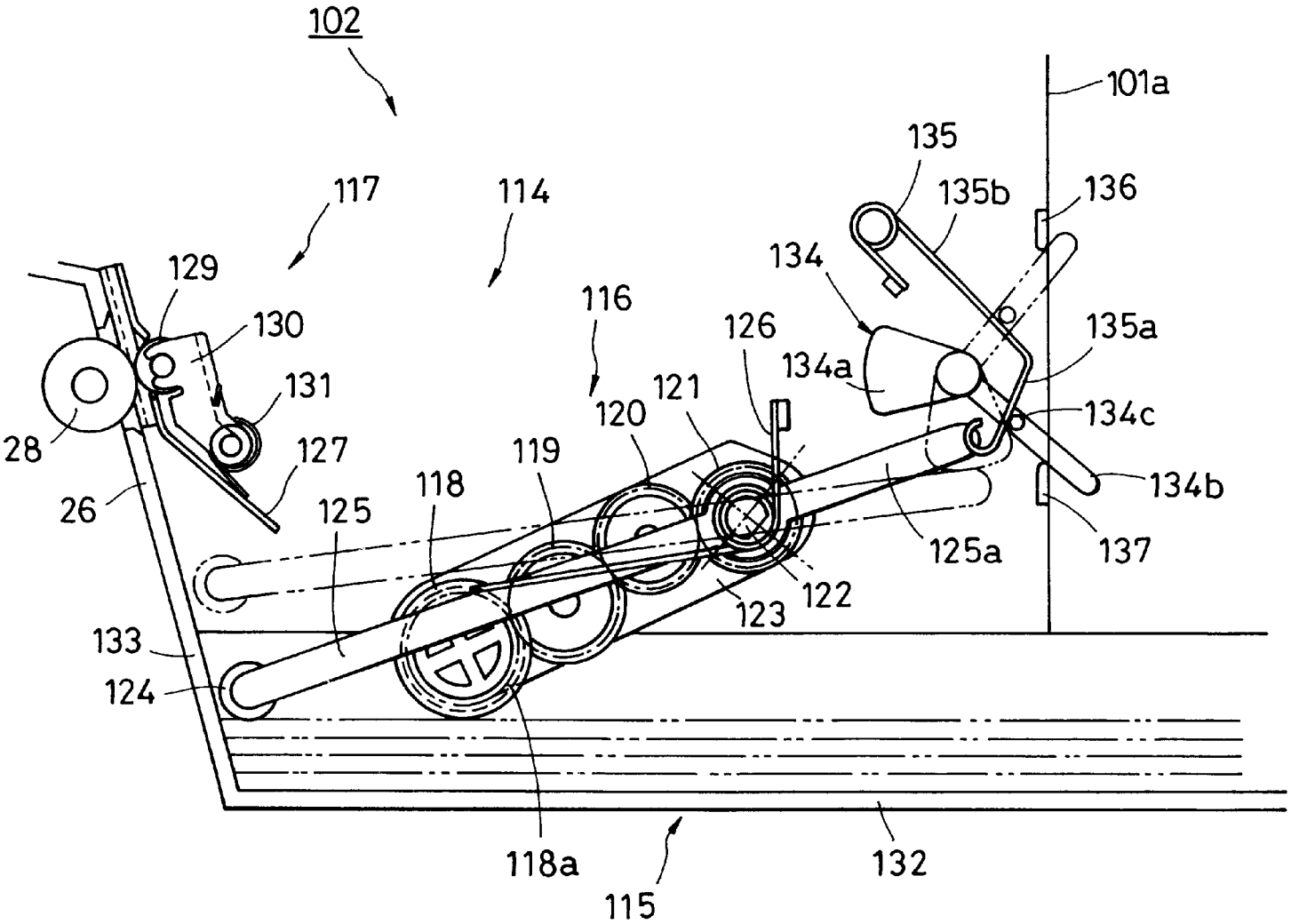
FIG. 12 is a longitudinal sectional view of a sixth embodiment of a sheet feeding apparatus according to the present invention.

The separation roller arm 125 is urged by an urging spring 126 in a counterclockwise direction as viewed in FIG. 12 figure so that the separation roller 124 is urged into contact with the leading end of the stack of sheets. The separation roller arm 125 has a pushing-down arm 125*a* extending beyond the driving shaft 122 in a direction opposite to the separation roller 124.

The transport part 117 includes a lower guide 126 for guiding the lower surface of a sheet being transported, an upper guide 127 for guiding the upper surface of the sheet being transported, a transport roller 128 for transporting the sheet in a predetermined direction, a transport roller 129 rotatably disposed at a location opposing the transport roller 128, roller holder 130 which is pivotably held by the upper guide 127 and which rotatably holds the transport roller 129, and a transport spring 131 for urging the roller holder 130 so that the transport roller 129 is urged against the transport roller 128.

The transport part 117 successively transports sheets, which are fed one by via the inclined separation plane 133, to an image forming part (not shown).

The sheet tray unit 115 includes a sheet tray 132 for supporting a stack of sheets thereon and an inclined separation plane 133 for separating a sheet fed by the sheet feeding unit 116 from the other sheets of the stack of sheets. Although, in the present embodiment, the sheet tray unit 132 and the inclined separation plane 133 are formed in an integral fashion, they may be formed into separate parts. If a plurality of sheets are fed by the sheet feed roller 118, they are bent and separated from one another when they travel along the inclined separation plane 133. The angle of the inclined separation plane 133 may be set to a proper value as required.

Now a description is given as to switching means for selectively switching the position of the separation roller 124 between a position in which the separation roller 124 is urged in contact with the stack of sheet placed on the sheet tray 132 and a position in which the separation roller 124 is apart from the stack of sheets.

A lever 134 serving as a manual operation member for switching the position is provided in a rotatable fashion on the main body 101*a* of the apparatus. The lever 134 includes a flag 134*a* and an arm 134*b*. The arm 134*b* has a protrusion 134*c* extending in a direction perpendicular to the page of the figure. The flag 134*a* is formed such that it is fitted with the pushing-down arm 125*a* of the separation roller arm 125 when the lever 134 is operated thereby turning the separation roller arm 125 in a clockwise direction in FIG. 1 and moving the separation roller 124 upward away from the stack of sheets into a released position.

The separation roller 124 is fixed, by fixing means, in the position where the separation roller 124 is urged in contact with the stack of sheets and in the position where the separation roller 124 is apart from the stack of sheets, as described below.

A torsion coil spring 135 is disposed in the vicinity of the lever 134 such that one end of the torsion coil spring 135 is fixed to the main body 101*a* of the apparatus. The torsion coil spring 135 has an extension which extends from the other end of the torsion coil spring 135 and which is bent in the middle thereof. The extension includes a first extension 135*a* with a free end and a second extension 135*b* extending directly from the main part of the torsion coil spring 135. The first and second extensions 135*a* and 135*b* are formed such that they are fitted with the protrusion 134*c* of the arm 134*b*.

When the lever 134 is operated to switch the position, the protrusion 134*c* is elastically fit with the torsion coil spring 135 in each switched position so that the lever 134 is urged by the elastic force of the torsion coil spring 135 in a direction in which the lever is turned into the switched position. More specifically, when the protrusion 134*c* receives the first extension 135*a* of the torsion coil spring 135, the lever 134 is urged in the clockwise direction in the figure. On the other hand, when the protrusion 134*c* receives the extension 135*b*, the lever 134 is urged in the counterclockwise direction as viewed in FIG. 12. The rotation of the lever 134, which would otherwise occur owing to the urging force of the torsion coil spring 135, is stopped by either an upper stopper 136 or a lower stopper 137 provided on the main body 101*a* of the apparatus, and thus the lever 134 is fixed at either corresponding location.

The operation of the sheet feeding apparatus having the above-described structure is described below.

When sheets with high rigidity (for example, thick sheets) are fed, the lever 134 is switched into a position where the arm 134*b* of the lever 134 is in an upper position (represented by a two-dot chain line). In this operation, the lever 134 is turned about the rotation axis thereof, and the flag 134*a* of the lever 134 pushes down the pushing-down arm 125*a* of the separation roller arm 125. The separation roller arm 125 is turned about the driving shaft 122 in the clockwise direction in the figure, and thus the separation roller 124 is moved away from the stack of sheets placed on the sheet tray 132. Herein, the position of the separation roller 124 (represented by a two-dot chain line in FIG. 12)

in which the separation roller 124 is apart from the stack of sheets is set such that the separation roller 124 does not come into contact with a sheet fed by the sheet feed roller 118.

In this state, the lever 134 is fixed in the position where it is urged by the extension 135*b* of the torsion coil spring 135 against the upper stopper 136, and thus separation roller arm 125 is fixed in a position in which the part including the separation roller 124 is lifted against the elastic force of the urging spring 126. As a result, the separation roller 124 is fixed in the position in which it is apart from the stack of the sheets placed on the sheet tray 132.

In this state, if a sheet with large rigidity is fed, the sheet being fed is bent between the inclined separation plane 133 and the sheet feed roller 118 without coming into contact with the separation roller 124. In this case, the sheet is bent more gradually (into a greater curvature) than in the case where the sheet is bent between the inclined separation plane 133 and the separation roller 124, and thus it is bent more easily. This allows the sheet to be separated and fed with a smaller feeding force and thus a smaller driving force (torque).

On the other hand, when sheets with small rigidity (for example, thin sheets) are fed, the lever 134 is switched into the position denoted by a solid line in the figure. In this operation, the lever 134 is turned about its rotation axis, and the flag 134*a* of the lever 134 is moved apart from the pushing-down arm 125*a* of the separation roller arm 125. In this state, the lever 134 is fixed in the position where it is urged by the torsion coil spring against the lower stopper 137 (as denoted by the solid line in FIG. 12).

When the separation roller arm 125 comes in the position in which it is apart from the pushing-down arm 125*a*, the separation roller arm 125 is urged by the urging spring 126 so that the separation roller 124 is urged into contact, between the inclined separation plane 133 and the sheet feed roller 118, with the stack of sheets placed on the sheet tray 132. In this state, if a sheet with low rigidity is fed, because the separation roller 124 presses the sheet at a part between the inclined separation plane 133 and the sheet feed roller 118, the sheet being fed by means of rotation of the sheet feed roller 118 is separated from the other sheets by the inclined separation plane 133 in a highly reliable fashion without resulting in a feeding error in which a plurality of sheets are fed at a time.

This is because when a sheet with low rigidity is fed, the separation roller 125 presses downward the sheet being fed at a part between the separation roller 124 and the inclined separation plane 133, and thus the sheet being pushed forward by the sheet feed roller 118 is bent between the inclined separation plane 133 and the separation roller 124. Because the distance between the inclined separation plane 133 and the separation roller 124 is small, the sheet is bent sharply (into a small curvature). As a result, sheets are easily separated from one another. This ensures that only one sheet is fed.

The construction described above has the following features.

If the lever 134 is turned upward when sheets with high rigidity such as thick sheets are fed, the separation roller 124 is fixed in the position in which it is apart from a sheet being fed, and thus the sheet can be fed by a smaller driving torque.

Conversely, when sheets with low rigidity such as thin sheets are fed, the lever 134 is turned downward so that the separation roller 124 is urged against a sheet being fed, at a part between the inclined separation plane 133 and the sheet feed roller 118 thereby ensuring that sheets are fed in a highly reliable fashion without resulting in a feeding error in which a plurality of sheets are fed at a time.

In general, a sheet with low rigidity such as a thin sheet tends to curl at its end. However, in the present sheet feeding apparatus, when a sheet with low rigidity is fed, the leading end of the sheet is pressed down by the separation roller 124, and thus the sheet is prevented from curling. As a result, the sheet is fed in a highly reliable fashion without encountering a separation error and without encountering a feeding error in which a plurality of sheets are fed at a time.

As described above, the present embodiment achieves the feature that when a sheet with high rigidity is fed, the sheet can be fed by a small driving torque while at the same time, when a sheet with low rigidity is fed, the separation roller 124 allows the sheet to be separated and fed in a highly reliable fashion without encountering a feeding error in which a plurality of sheets are fed at a time.

Although in the present embodiment, the lever 134 and the tension coil spring are employed to move the separation roller 124, another device such as a toggle switch may also be employed.

Seventh Embodiment

A seventh embodiment of the present invention is described below with reference to FIGS. 13 and 14. In this seventh embodiment of the sheet feeding apparatus, elements corresponding to those in the sixth embodiment are denoted by the same reference numerals and they are not described in further detail here.

Figure 13:
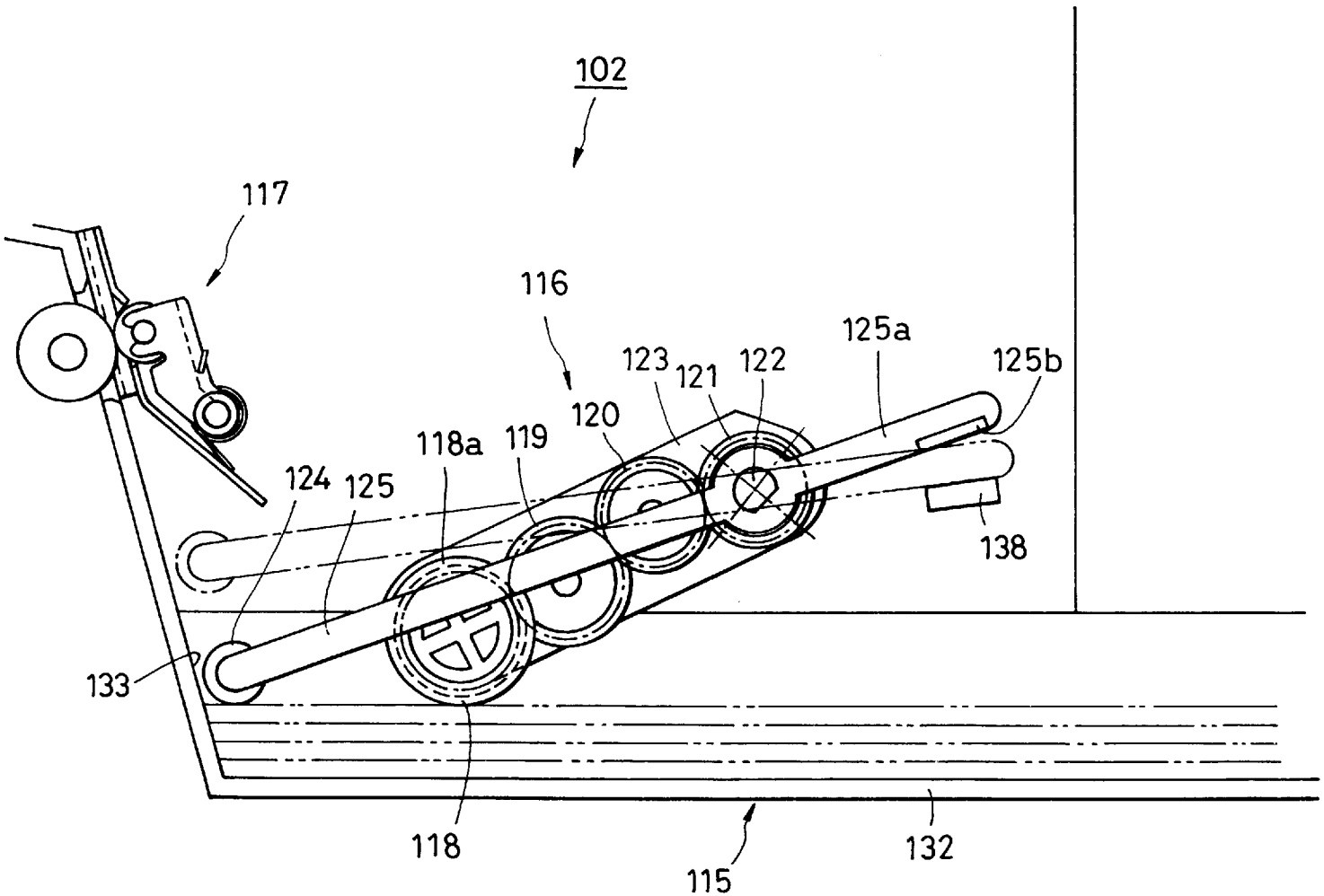
FIG. 13 is a longitudinal sectional view of a seventh embodiment of a sheet feeding apparatus according to the present invention.

As shown in FIG. 13, a solenoid 138 serving as separation roller driving means is disposed in the vicinity of a pushing-down arm 125*a* of a separation roller arm 125 supporting a separation roller 124. A coupling member 125*b*, for coupling the pushing-down arm 125*a* of the separation roller arm 125 with the solenoid 138, is integrally formed with the pushing-down arm 125*a*. If the solenoid is turned on, the coupling member 125*b* is pulled by the solenoid 138, and thus the pushing-down arm 125*a* is turned in a clockwise direction. As a result, the separation roller 124 is lifted via the separation roller arm 125.

Figure 14:
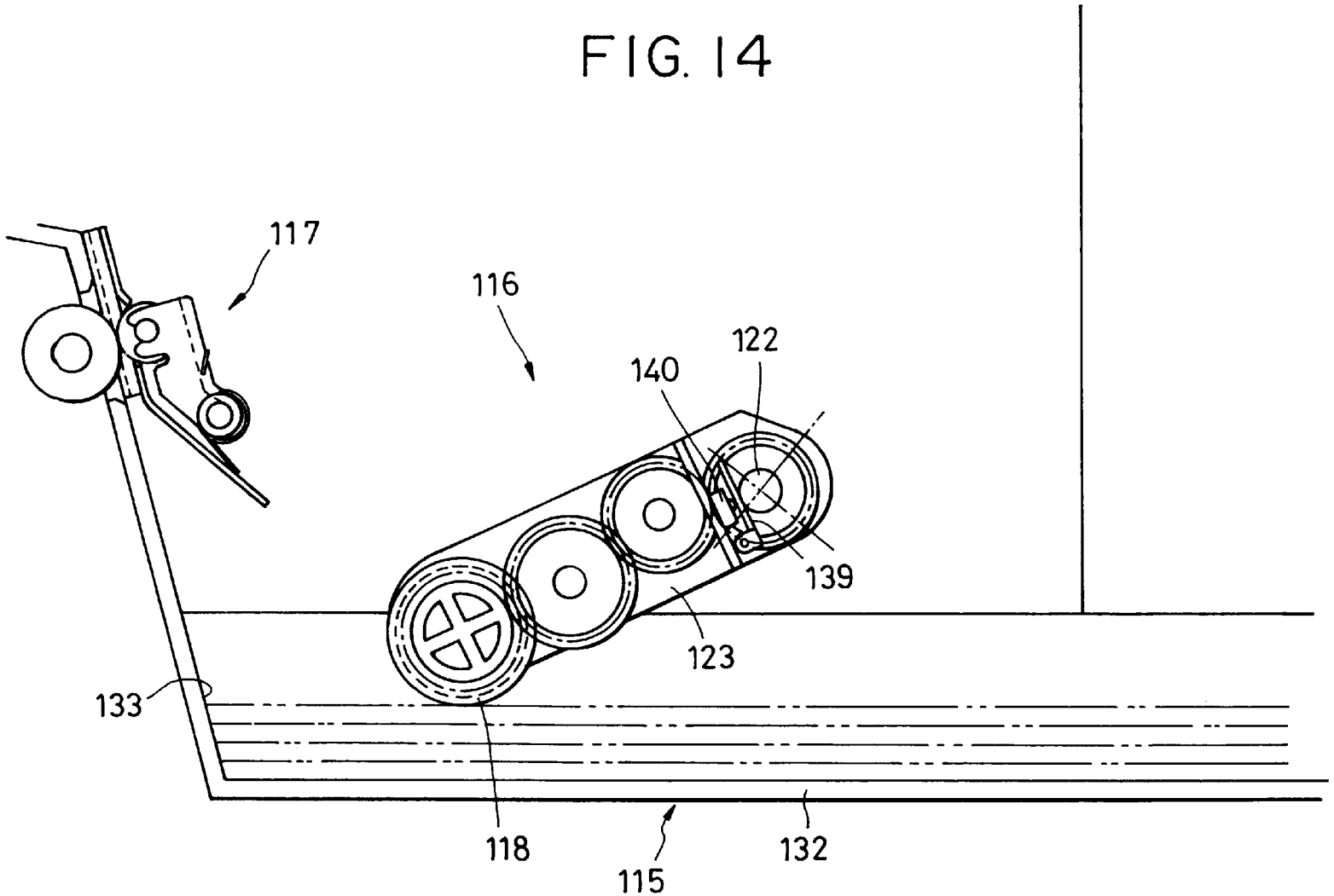
FIG. 14 is a cross-sectional view illustrating main parts of the seventh embodiment of the sheet feeding apparatus.

As shown in FIG. 14, a contacting plate 139 is pivotably disposed on a sheet roller holder 123 such that the contacting plate 139 is in contact with a driving shaft 122. A load cell 140 is disposed such that it is in contact with the surface of the contacting plate 139 opposite to the surface in contact with the driving shaft 122 thereby detecting the force imposed by the sheet roller holder upon the driving shaft 122. The solenoid 138 is controlled by control means (not shown) as follows. If the load cell 140 detects a force greater than a predetermined value, the solenoid 128 is turned on. Conversely, if the load cell 140 detects a force smaller than a predetermined value, the solenoid 138 is turned off.

The operation of the present embodiment is described below.

When a sheet with high rigidity (such as a thick sheet) is fed, because the separation roller 124 is urged into contact, between the inclined separation plane 133 and the sheet feed roller 118, with a stack of sheets placed on the sheet tray 132, the sheet with large rigidity is sharply bent between the separation roller 124 and the inclined separation plane 133, and thus a large feeding force is obtained. A reaction force is imposed upon the sheet feed roller 118, and thus the sheet feed roller 118 is pushed in a direction opposite to the transport direction. The sheet feed roller 118 pushes the sheet feed roller holder 123 which, in turn, pushes the driving shaft 122. The load cell 140 monitors the pushing force imposed by the sheet feed roller holder 123 upon the driving shaft 122.

If the feeding force increases, the sheet feed roller 118 feeds the sheet with a greater feeding force. As a result, a greater reaction force is imposed upon the sheet feed roller 118, which in turn pushes the sheet roller holder 123 with a greater force. As a result, the sheet feed roller holder 123 pushes the driving shaft 122 with a greater force.

If the load cell 140 detects a force greater than a predetermined value, the solenoid 138 is turned on, and the coupling member 125*b* of the pushing-down arm 125*a* of the separation roller arm 125 is pulled by the solenoid 138. As a result, the separation roller arm 125 is turned against the urging force of the urging spring 126, and the separation roller 124 is moved away from the sheet being fed (into a position represented by a two-dot chain line in FIG. 13).

In this state, because the sheet is bent between the sheet feed roller 118 and the inclined separation plane 133, slight bending is sufficient to allow the sheet to be fed. As a result, it is possible to feed the sheet with a smaller feeding force and thus a smaller driving torque.

In the case of a sheet with low rigidity (such as a thin sheet), when a sheet at the top of the stack of sheets placed on the sheet tray 132 is fed by means of rotation of the sheet feed roller 118, a reaction force against the sheet feeding force is imposed upon the sheet feeding roller 118. As a result, the sheet feed roller 118 pushes the sheet roller holder 123 which in turn pushes the driving shaft 122.

However, when the sheet has low rigidity, it is easy to sharply bend the sheet, and a small force is required to feed the sheet. Therefore, in this case, the pushing force imposed by the sheet roller holder 123 upon the driving shaft 122 is small, and the force detected by the load cell 140 is smaller than the predetermined value. As a result, during the operation of separating and feeding the sheet, the solenoid 138 is maintained in the off-state, and the separation roller 124 is maintained in contact with the sheet (as denoted by a solid line in FIG. 13). Because the separation roller 124 is maintained in the state in which the separation roller 124 is urged into contact, between the inclined separation plane 133 and the sheet feed roller 118, with the stack of sheets placed on the sheet tray 132, the sheet with small rigidity is bent between the separation roller 124 and the inclined separation plane 133, and thus the sheet being fed is easily separated from the other sheets and fed in a highly reliable fashion without encountering a feeding error in which a plurality of sheets are fed at a time.

The construction described above has the following features.

When a sheet with large rigidity such as a thick sheet is fed, the pushing force imposed by the sheet feed roller holder 123 upon the driving shaft 122 increases greatly. If this pushing force detected by the load cell 140 becomes greater than a predetermined value, the separation roller 124 is moved away from the sheet. In this state, the sheet is not bent by the separation roller 124 but by the sheet feed roller 118. As a result, the sheet is fed with a smaller torque.

On the other hand, when a sheet with small rigidity such as a thin sheet is fed, the pushing force imposed by the sheet feed roller holder 123 upon the driving shaft 122 is small, and thus the force detected by the load cell 140 is smaller than the predetermined value. As a result, the separation roller 124 is maintained in the state in which the separation roller 124 is urged into contact, between the inclined separation plane 133 and the sheet feed roller 118, with the sheet being fed. This makes it possible to separate and feed the sheet in a highly reliable fashion without encountering a feeding error in which a plurality of sheets are fed at a time.

Furthermore, as in the sixth embodiment, the sheet is prevented from curling at its leading end. Therefore, the sheet is fed in a highly reliable fashion without encountering a separation error or a feeding error in which a plurality of sheets are fed at a time.

Because the position of the separation roller 124 is automatically switched between the position in which the separation roller 124 presses the sheet fed by the sheet feed roller 118 and the position in which the separation roller 124 is apart from the sheet fed by the sheet feed roller 118, depending on the value detected by the load cell 140, a user does not need to determine whether sheets have high or low rigidity. Thus, the position of the separation roller 124 is correctly switched without encountering an operation error which can otherwise occur due to user's incorrect determination.

As described above, the sheet feeding apparatus of the present embodiment achieves the feature that when a sheet with high rigidity is fed, the sheet can be fed by a small driving torque without losing the feature that when a sheet with low rigidity is fed, the separation roller 124 allows the sheet to be separated and fed in a highly reliable fashion without encountering a feeding error in which a plurality of sheets are fed at a time. Furthermore, because the position of the separation roller 124 for sheets with large rigidity and that for sheets with small rigidity are automatically switched, the sheet feeding apparatus operates in a highly reliable fashion without encountering feeding errors.

Although in the present embodiment, the solenoid 138 is employed as the separation roller driving means, other means such as a motor may also be employed.

Eighth Embodiment

An eighth embodiment of the present invention is described below with reference to FIG. 15. In this eighth embodiment of the sheet feeding apparatus, elements corresponding to those in the sixth or seventh embodiment are denoted by the same reference numerals and they are not described in further detail here.

As in the seventh embodiment, solenoid 138 is disposed in the vicinity of a pushing-down arm 125*a* of a separation roller arm 125 supporting a separation roller 124. A coupling member 125*b*, for coupling the pushing-down arm 125*a* of the separation roller arm 125 with the solenoid 138, is integrally formed with the pushing-down arm 125*a*.

Furthermore, as in the seventh embodiment described above with reference to FIG. 14, a contacting plate 139 is pivotably disposed on a sheet roller holder 123 such that the contacting plate 139 is in contact with a driving shaft 122. A load cell 140 is disposed such that it is in contact with the surface of the contacting plate 139 opposite to the surface in contact with the driving shaft 122 thereby detecting the force imposed by the sheet roller holder upon the driving shaft 122. If the load cell 140 detects a force greater than a predetermined value, the solenoid 138 is turned on. On the other hand, if the load cell 140 detects a force greater than the predetermined value, the solenoid A 128 is turned on.

As will be described in detail below, the present embodiment is characterized by a movable inclined separation plane.

Figure 15:
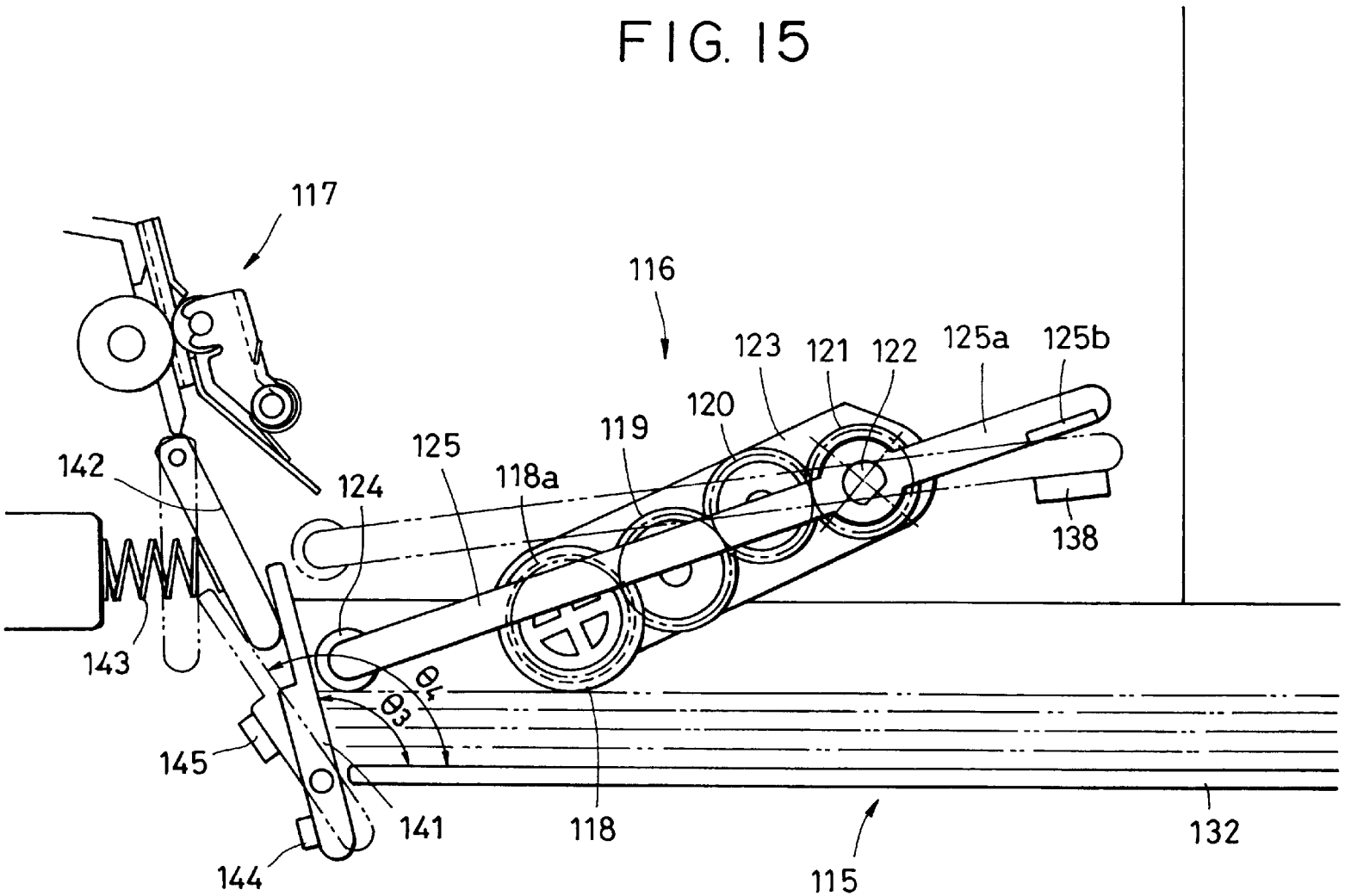
FIG. 15 is a longitudinal sectional view of an eighth embodiment of a sheet feeding apparatus according to the present invention.

With reference to FIG. 15, sheet tray unit 115 includes a sheet tray 132, a movable inclined separation plane 141, and a movable transport plane 142. Turning means for turning the movable inclined separation plane 141 is composed of a spring 143 serving as urging means, an inclined separation plane stopper 144, and a solenoid 145 serving as inclined separation plane driving means. The movable inclined separation plane 141 and the movable transport plane 142 are pivotably disposed on the main body of the apparatus. When seen in the transport direction, the movable inclined separation plane 141 is overlaps on the movable transport plane 142.

The spring urges the movable transport plane 142 which in turn urges the movable inclined separation plane 141 into a position (first position, represented by a solid line in FIG. 15) in which the movable inclined separation plane 141 makes an angle θ3 with respect to the surface of the sheet tray 132 on which a stack of sheets are placed. The inclined separation plane stopper 144 is disposed so that the urged movable inclined separation plane 141 is fixed at the angle θ3.

The solenoid 145 is disposed in the vicinity of the movable inclined separation plane 141 so that when the movable inclined separation plane 141 is pulled by the solenoid 145, the movable inclined separation plane 141 is moved into a position (second position, represented by a two-dot chain line in FIG. 15) in which the movable inclined separation plane 141 makes angle θ4 with respect to the surface of the sheet tray 132. More specifically, if the solenoid 145 is turned on, the movable inclined separation plane 141 is pulled by the solenoid 145 against the urging force by the spring 143 into the second position in which the movable inclined separation plane 141 makes angle θ4 which is greater than angle 03.

The solenoid 145 is controlled by control means (not shown) in accordance with detection of the load cell 140 as follows. If the load cell 140 detects a force greater than a predetermined value, the solenoid 145 is turned on. Conversely, if the load cell 140 detects a force smaller than a predetermined value, the solenoid 145 is turned off.

The operation of the present embodiment is described below.

When a sheet with large rigidity is fed, because the separation roller 124 is urged into contact, between the inclined separation plane 133 and the sheet feed roller 118, with the stack of sheets placed on the sheet tray 132, and the separation roller 124 attempts to bend the sheet with high rigidity between the inclined separation plane 133 and the separation roller 124, and thus a large torque is needed to feed the sheet. If the sheet feed roller 118 rotates and pushes the sheet in the transport direction, the sheet feed roller 118 receives a reaction force which pushes the sheet feed roller 118 in a direction opposite to the transport direction. Thus, the sheet feed roller 118 pushes the sheet feed roller holder 134 which in turn pushes the driving shaft 122. The load cell 140 detects this pushing force imposed by the sheet feed roller holder 123 upon the driving shaft 122.

If the torque driving the sheet feed roller 118 increases, the sheet feed roller 118 pushes the sheet with a greater force, and thus the sheet feed roller 118 receives a greater reaction force. As a result, the sheet feed roller 118 pushes the sheet feed roller holder 123 with a greater force, and the sheet feed roller holder 123 pushes the driving shaft 122 with a greater force.

If the load cell 140 detects a force greater than the predetermined value, the solenoid 138 and the solenoid 145 are both turned on. As a result, the coupling member of the pushing-down arm 125*a* of the separation roller arm 125 is pulled by the solenoid 138. Thus, the separation roller arm 125 is turned against the urging force of the urging spring 126, and the separation roller 124 is moved away from the stack of sheets placed on the sheet tray 132. On the other hand, the movable inclined separation plane 141 is also pulled by the solenoid 145, and thus the movable inclined separation plane 141 is moved against the urging force of the spring 143 from the first position into the second position. As a result, the angle of the movable inclined separation plane 141 with respect to the surface of the sheet tray 132 increases.

In this state, the sheet is bent between the sheet feed roller 118 and the inclined separation plane 133. Because the movable inclined separation plane 141 is inclined at the great angle θ4, the sheet can be separated with a smaller force than is required in the second embodiment. Thus, a smaller driving torque is required to feed the sheet.

In the case of a sheet with small rigidity, if the sheet feed roller 118 rotates and pushes the sheet placed on the sheet tray 132 in the transport direction, the sheet feed roller 118 receives a reaction force. As a result, the sheet feed roller 118 pushes the sheet feed roller holder 123 which in turn pushes the driving shaft 122.

However, when the sheet being fed has small rigidity, the sheet can be separated and fed with a small driving torque. Therefore, the pushing force imposed by the sheet feed roller holder 123 upon the driving shaft 122 is weak, and thus the force detected by the load cell 140 is smaller than the predetermined value. Thus, the solenoid 138 and the solenoid 145 are both maintained in the off-states, and the separation roller 124 is maintained in the state in which it is urged into contact with the sheet, during the separating and feeding operation. Because the separation roller 124 is urged into contact, between the inclined separation plane 133 and the sheet feed roller 118, with the stack of sheets placed on the sheet tray 132, the sheet with low rigidity being fed is bent between the separation roller 124 and the inclined separation plane 133. As a result, the sheet is easily separated from the other sheets. This ensures that the sheet is fed in a highly reliable fashion without encountering a feeding error in which a plurality of sheets are fed at a time.

The construction described above has the following features.

When a sheet with high rigidity such as a thick sheet is fed, the pushing force imposed by the sheet feed roller holder 123 upon the driving shaft 122 becomes great. If this pushing force detected by the load cell 140 becomes greater than a predetermined value, the separation roller 124 is moved away from the stack of sheets placed on the sheet tray 132. In this state, the sheet is not bent by the separation roller 124 but by the sheet feed roller 118. Besides, because the movable inclined separation plane 141 is in the position in which the movable inclined separation plane 141 is inclined at the greater angle with respect to the surface of the sheet tray 132, the sheet can be fed with a further small torque.

On the other hand, when a sheet with small rigidity such as a thin sheet is fed, the pushing force imposed by the sheet feed roller holder 123 upon the driving shaft 122 is small, and thus the force detected by the load cell 140 is smaller than the predetermined value. As a result, the separation roller 124 is maintained in the state in which the separation roller 124 is urged into contact, between the inclined separation plane 133 and the sheet feed roller 118, with the stack of sheets played on the sheet tray 132. This makes it possible to separate and feed the sheet in a highly reliable fashion without encountering a feeding error in which a plurality of sheets are fed at a time.

Because the position of the separation roller 124 is automatically switched between the position in which the separation roller 124 presses the stack of sheets placed on the sheet tray 132 and the position in which the separation roller 124 is apart from the stack of sheets, depending on the value detected by the load cell 140, a user does not need to determine whether sheets have high or low rigidity. Thus, the position of the separation roller 124 is correctly switched without encountering an operation error which can otherwise occur due to user's incorrect determination.

As described above, the sheet feeding apparatus of the present embodiment achieves the feature that when a sheet with high rigidity is fed, the separation roller 124 is moved away from the stack of sheets placed on the sheet tray 132 and the inclined separation plane 133 is inclined into the greater angle position thereby allowing the sheet to be fed with a small driving torque, without losing the feature that when a sheet with small rigidity is fed, the separation roller 124 allows the sheet to be separated and fed in a highly reliable fashion without encountering a feeding error in which a plurality of sheets are fed at a time. Furthermore, the sheet feeding apparatus of the present embodiment has the feature where the position of the separation roller 124 for a sheet with high rigidity and that for a sheet with low rigidity are automatically switched.

Although in the present embodiment, the solenoid is employed as the separation roller driving means, other means such as a motor may also be employed. Furthermore, the solenoid employed as the inclined separation plane driving means for turning the inclined separation plane may also be replaced with other means such as a motor.

Furthermore, although in the present embodiment, the turning means for turning the movable inclined separation plane 141 between the first and second positions is composed of the spring 143 for urging the movable inclined separation plane 141 toward the first position and the solenoid 145 for turning the movable inclined separation plane 141 into the second position, the turning means may also be composed of a solenoid and a spring which have opposite functions. The solenoid 145 may be replaced with other means such as a motor.

Ninth Embodiment

In the seventh embodiment described above, the pushing force imposed by the sheet feed roller holder 123 upon the driving shaft 122 is detected by the load cell 140, and the position of the separation roller for a sheet with large rigidity and that for a sheet with small rigidity are switched depending on the force detected by the load cell 140. The switching may also be accomplished in a different manner.

In this ninth embodiment, a technique is disclosed for accomplishing the switching using the change in tension of a gear belt 146 provided for driving the sheet feed roller 118.

The ninth embodiment of the present invention is described below with reference to FIGS. 16 and 17. In this ninth embodiment of the sheet feeding apparatus, elements corresponding to those in the sixth embodiment are denoted by the same reference numerals and they are not described in further detail here.

A sheet feeding unit 116 includes: a sheet feed roller 118 which rotates together with a sheet feed gear 118*a*; a driving gear 121 integrally formed with a driving shaft 122; a sheet feed roller holder 123 which rotatably supports the sheet feed roller 118 and the driving gear 121 and which is pivotably attached to the driving shaft 122; a gear belt 146, disposed between the sheet feed gear 118*a* and the driving gear 121, for transmitting a driving force between the sheet feed gear 118*a* and the driving gear 121; a tension roller 147 urged into contact with the gear belt 146 so that the gear belt 146 has a proper tension; a tension roller holder 148 for rotatably supporting the tension roller 147; and a tension spring 149 for urging the tension roller holder 148 thereby applying a tension to the gear belt 146.

A guide 123*a* is formed on the sheet feed roller holder 123 so that the tension roller holder 148 can move along the guide 123*a*. A separation roller 124 rotatably supported by a separation roller arm 125 at its one end is disposed between an inclined separation plane 133 and the sheet feed roller 118. The other end of the separation roller arm 125 is pivotably supported by the driving shaft 122. Furthermore, the separation roller arm 125 is urged by an urging spring so that the separation roller 124 is urged toward a sheet. The tension roller holder 148 includes an arm 148*a* which extends in a direction perpendicular to the page of FIG. 16 and which is disposed such that the arm 148*a* always engages with a lower part of the separation roller arm 125.

If a sheet with high rigidity is fed, the separation roller 124 is first in a state in which it is urged into contact, between the inclined separation plane 133 and the sheet feed roller 118, with the sheet being fed. Thus, the separation roller 124 attempts to sharply bend the sheet with large rigidity between the separation roller 124 and the inclined separation plane 133. As a result, a great feeding force is required, and thus the driving torque increases.

The great driving torque imposed upon the driving gear 121 causes a great tension to be applied to the driving side of the gear belt 146. As a result, the tension of the gear belt 146 causes the tension roller 147 to be pushed upward against the urging force of the tension spring 149. Thus, the tension roller 147 and the tension roller holder 148 are lifted. As a result, the separation roller arm 125 is pushed upward by the tension roller holder's arm 148*a* which engages with the separation roller arm 125. As a result, the separation roller 124 is moved away from the sheet being fed (FIG. 17).

Thus, eventually, the sheet with high rigidity is bent between the sheet roller 118 and the inclined separation plane 133, and thus it becomes possible to feed the sheet with a smaller feeding force and thus a smaller driving torque.

In the case where a sheet with low rigidity is fed, the sheet can be separated with a small feeding force, and thus the driving torque is small. In this case, therefore, a large tension is not applied to the gear belt 146. As a result, the separation roller 124 is maintained in the state in which the separation roller 124 is urged into contact, between the inclined separation plane 133 and the sheet feed roller 118, with the sheet being fed. Thus, the sheet with small rigidity is sharply curved between the separation roller 124 and the inclined separation plane 133. This allows the top sheet to be easily separated from the other sheets. Thus, the sheet is separated and fed in a highly reliable fashion without encountering a feeding error in which a plurality of sheets are fed at a time.

The construction described above has the following features.

Figure 17:
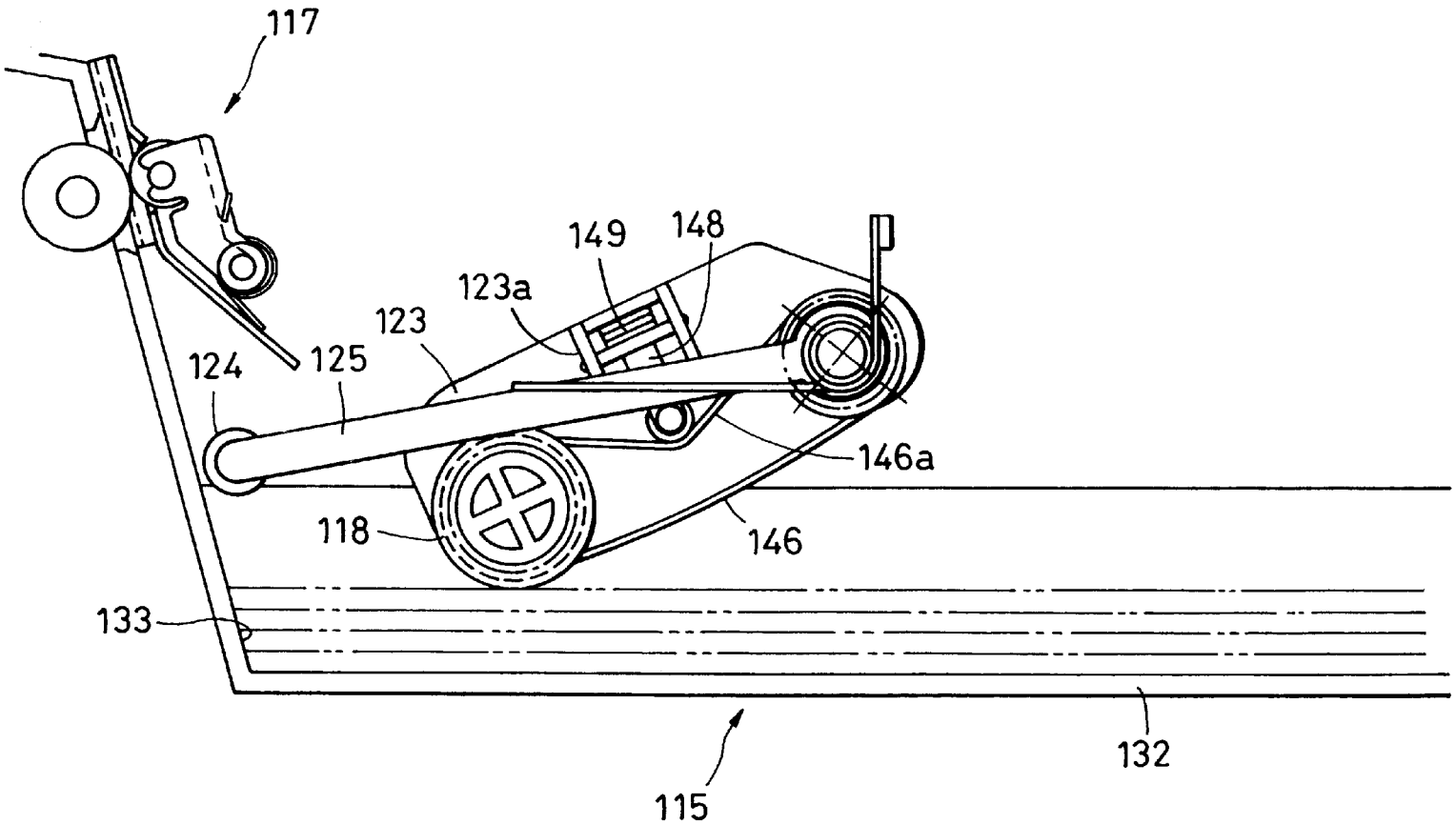
FIG. 17 is schematic diagram illustrating the motion of a separation roller of the ninth embodiment of the sheet feeding apparatus according to the present invention.

When a sheet with high rigidity such as a thick sheet is fed, the gear belt 146 has a great tension, and the tension roller 147 is pushed upward against the urging force of the tension spring 149, as shown in FIG. 17. As a result, the separation roller 124 is moved away from the sheet. Thus, the sheet is not bent by the separation roller 124 but gradually bent by the sheet roller 118. This allows the sheet to be fed with a small torque.

Figure 16:
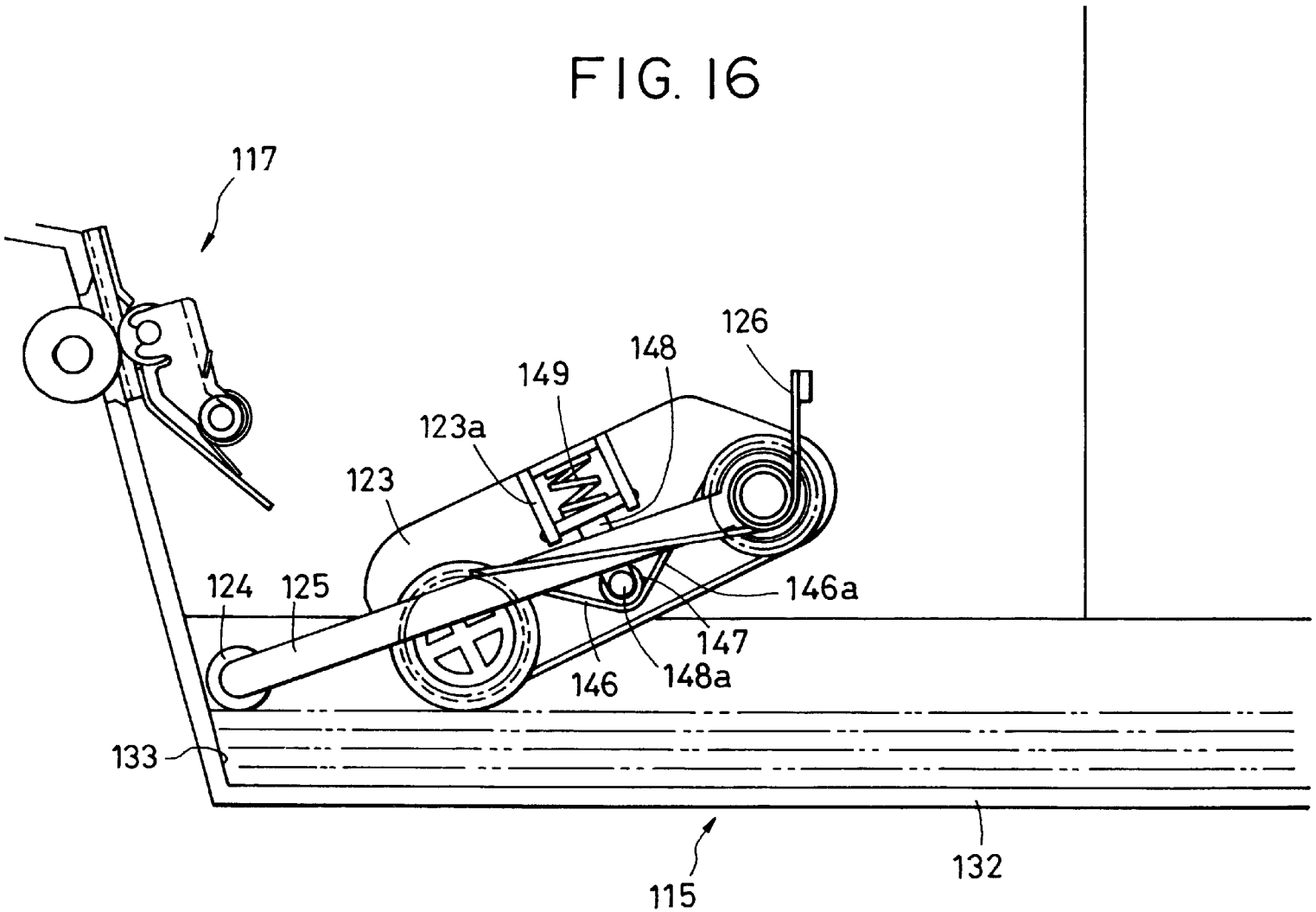
FIG. 16 is a longitudinal sectional view of a ninth embodiment of a sheet feeding apparatus according to the present invention.

On the other hand, when a sheet with low rigidity such as a thin sheet is fed, the gear belt 146 has a low tension, and thus the tension roller 147 is not lifted by the gear belt 146, as shown in FIG. 16. As a result, the separation roller 124 is maintained in the state in which the separation roller 124 is urged into contact, between the inclined separation plane 133 and the sheet feed roller 118, with the sheet being fed. This makes it possible to separate and feed the sheet in a highly reliable fashion without encountering a feeding error in which a plurality of sheets are fed at a time.

Depending on whether or not the tension roller 147 is lifted by the tension of the gear belt 146 against the urging force of the tension spring 149, the position of the separation roller 124 is automatically switched between the position in which the separation roller 124 is urged into contact with a stack of sheets placed on the sheet tray 132 and the position in which the separation roller 124 is apart from the stack of sheets. Thus, a user does not need to determine whether sheets have large or small rigidity. Thus, the position of the separation roller 124 is correctly switched without encountering an operation error which can otherwise occur due to user's incorrect determination.

The present embodiment makes it possible to achieve similar features to those achieved by the seventh embodiment without having to use expensive components such as a load cell 140 and a solenoid which are required in the seventh embodiment.

Although in the ninth embodiment, gears and a gear belt are used, a combination of pulleys and a flat belt may also be employed.

Although the present invention has been described above with reference to specific embodiments, the invention is not limited to those specific embodiment. For example, parts or mechanisms employed in those embodiments may be combined. More specifically, the movable inclined separation plane disclosed in the eighth embodiment may be combined with the mechanism of switching the separation roller disclosed in the sixth or ninth embodiment. In this case, the movable inclined separation plane may be automatically turned depending on the position of the separation roller arm or may be turned in response to a manual operation performed upon an operation member such as a link mechanism.

Furthermore, although in the ninth embodiment, a stack of sheets are supported on a sheet tray in a horizontal position, the sheet tray may be inclined, and an inclined separation plane may be disposed at a level lower than the sheet tray so that a sheet is fed forward and separated at a lower level. A sheet plate and an inclined separation plane may be formed on a cassette attachable/removable to/from the main body of an apparatus.

An example of an image forming apparatus (laser beam printer) using a sheet feeding apparatus according to the present invention is described below with reference to FIG. 18.

Figure 18:
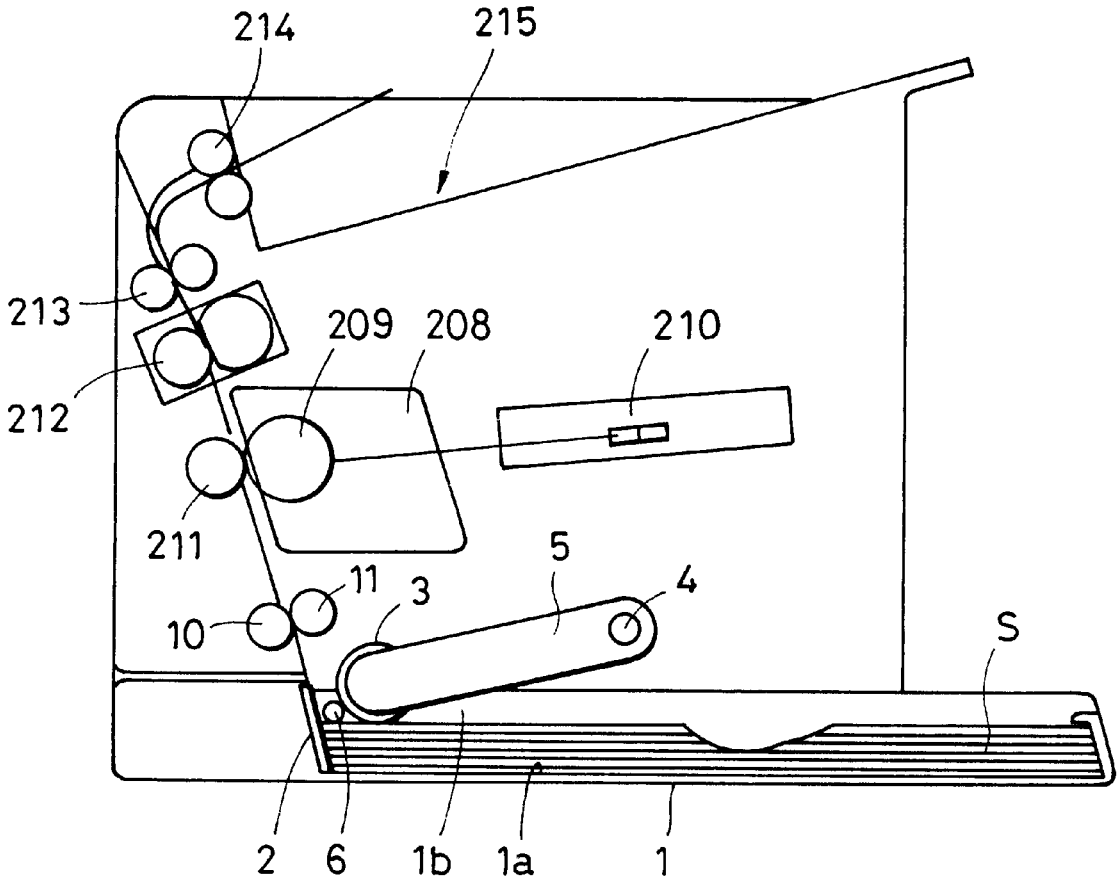
FIG. 18 is a sectional view of an image forming apparatus on which a sheet feeding apparatus according to the present invention is installed.

In FIG. 18, a mechanism for forming an image on a sheet fed by the sheet feeding apparatus includes: a toner cartridge 208; a photosensitive drum 209 held by the toner cartridge 209; a laser scanner 210 for forming a latent image on the photosensitive drum 209; a transfer roller 211 for transferring a toner image, which is formed by developing the latent image on the photosensitive drum 209 with toner in the toner cartridge, onto the sheet; a fuser 212 for fusing the toner image on the sheet; feed-out rollers 213 for transporting the sheet after completion of the fusing process; a feed-out roller 214 for transporting the sheet to the outside of the image forming apparatus; and a fed-out sheet tray 215 for placing fed-out sheets.

In this image forming apparatus having the above structure, the sheet feed roller 203 is urged into contact with a sheet at the top of a stack of sheets S placed on the sheet plate. If the sheet feed roller 3 starts to rotate, a feeding force due to friction is applied to the sheet at the top of the stack of sheets. As a result, the sheet is pushed forward into a state in which the sheet is curved between the sheet feed roller 3 and the inclined separation plane 2. Thus, the sheet is separated from the other sheets and fed.

The sheet is then transported by means of rotation of the transport rollers 10 and 11 to a nip formed between the photosensitive drum 209 and the transfer roller 211. A latent image formed on the photosensitive drum 209 by the scanner 210 is developed in the toner cartridge 208 and transferred onto the sheet via the transfer roller 211. The toner image formed on the sheet is then fused by the fuser 212. The sheet is then fed out to the outside of the image forming apparatus via the feed-out rollers 213 and the feed-out roller 214 and placed on the fed-out sheet tray 215.

While the present invention has been described with respect to what is presently considered to be the preferred embodiments, it is to be understood that the invention is not limited to the disclosed embodiments. The present invention is intended to cover various modifications and equivalent arrangements included within the spirit and scope of the appended claims.

What is claimed is:

1. A sheet feeding apparatus comprising:

sheet supporting means for supporting a stack of sheets;

a sheet feed roller, in contact with an upper surface of a sheet at the top of said stack of sheets supported by said sheet supporting means, for feeding said sheet;

an inclined separation plane for separating the sheet fed by said sheet feed roller from the stack of sheets;

a rotatable separation roller, disposed between said inclined separation plane and said sheet feed roller, for pressing the upper surface of the sheet fed by said sheet feed roller; and roller supporting means for movably supporting said rotatable separation roller.

2. A sheet feeding apparatus according to claim 1, wherein said rotatable separation roller is supported by said roller supporting means so that said separation roller is movable in accordance with the rigidity of a sheet being separated and fed, wherein when a sheet of low rigidity is fed by said sheet feed roller along said inclined separation plane, said sheet is bent starting from a line where said sheet is in contact with said separation roller, and when a sheet of high rigidity is fed, said separation roller is lifted by said sheet and said sheet is bent starting from a line where said sheet is in contact with said sheet feed roller.

3. A sheet feeding apparatus according to claim 2, wherein said separation roller is disposed, at a location thereof with respect to a direction across the width of the stack of sheets supported on said sheet supporting means, outside said inclined separation plane and such that a part of the perimeter of said separation roller is located at a position shifted from a plane spanned by said inclined separation plane in a direction opposite to the stack of sheets.

4. A sheet feeding apparatus according to claim 3, wherein:

said sheet feed roller is connected to a sheet feed roller arm rotatably held by a roller arm shaft; and said roller supporting means includes a roller holder which rotatably supports said separation roller and which is pivotably held by a shaft.

5. A sheet feeding apparatus according to claim 4, wherein the rotation shaft of said roller holder is said roller arm shaft.

6. A sheet feeding apparatus according to claim 4, wherein the rotation shaft of said roller holder is disposed on said roller arm.

7. A sheet feeding apparatus according to claim 1, wherein said sheet feed roller is disposed at a location opposing said inclined separation plane, and said rotatable separation roller is disposed at both sides of said inclined separation plane such that the location thereof with respect to a direction across the width of the stack of sheets is outside said inclined separation plane.

8. A sheet feeding apparatus comprising:

sheet supporting means for supporting a stack of sheets;

a sheet feed roller, in contact with an upper surface of a sheet at the top of said stack of sheets supported by said sheet supporting means, for feeding said sheet;

an inclined separation plane for separating the sheet fed by said sheet feed roller from the stack of sheets;

a rotatable separation roller which is disposed between said inclined separation plane and said sheet feed roller and which is urged against both the upper surface of the sheet and said inclined separation plane; and roller supporting means for supporting said separation roller such that said separation roller is movable in accordance with the rigidity of the sheet being fed.

9. A sheet feeding apparatus according to claim 8, wherein said rotatable separation roller is supported by said roller supporting means so that when a sheet of low rigidity is fed along said inclined separation plane, said sheet is bent starting from a line where said sheet is in contact with said separation roller, and when a sheet of high rigidity is fed, said separation roller is lifted by said sheet and said sheet is bent starting from a line where said sheet is in contact with said sheet feed roller.

10. A sheet feeding apparatus according to claim 9, wherein:

openings are formed in right and left side walls, respectively, of said sheet supporting means, and said openings are elongated in a direction parallel to said inclined separation plane; and said rotation roller is movably engaged with said openings; and further comprising a spring for urging said separation roller against both said inclined separation plane and the upper surface of the sheet.

11. A sheet feeding apparatus according to claim 1 or 8, further comprising a release mechanism for moving said sheet feed roller and said separation roller from the sheet supported by said sheet supporting means.

12. A sheet feeding apparatus according to claim 11, wherein said release mechanism includes a linking mechanism for linking said release mechanism with an operation of operating means.

13. A sheet feeding apparatus according to claim 12, wherein said operating means is a cover which covers the sheet supported on said sheet supporting means and which is openable and closable when sheets are replenished on said sheet supporting means, and wherein when said cover is opened, said sheet feed roller and said separation roller are moved away from the sheet.

14. A sheet feeding apparatus comprising:

sheet supporting means for supporting a stack of sheets;

sheet feeding means, in contact with an upper surface of a sheet at the top of the stack of sheets supported by said sheet supporting means, for feeding said sheet;

an inclined separation plane for separating the sheet fed by said sheet feeding means from the stack of sheets;

a rotatable separation roller, disposed between said inclined separation plane and said sheet feeding means, for pressing the upper surface of the sheet fed by said sheet feed means; and switching means for switching said separation roller between a position in which said separation roller presses the upper surface of the sheet being fed and a position in which said separation roller is apart from the upper surface of the sheet being fed.

15. A sheet feeding apparatus according to claim 14, wherein said switching means switches the position of said separation roller such that said separation roller is in the position apart from the upper surface of the sheet being fed when said sheet has high rigidity and said separation roller is in the position pressing the upper surface of the sheet being fed when said sheet has low rigidity.

16. A sheet feeding apparatus according to claim 15, wherein when the separation roller is in the position in which said separation roller presses the sheet, said separation roller presses said sheet so that said sheet is sharply bent by said inclined separation plane.

17. A sheet feeding apparatus according to claim 15, wherein:

said separation roller is supported by swingable roller supporting means; and said switching means includes an operating member, engaged with said roller supporting means, for manually swinging said roller supporting means so as to switch the position of said separation roller.

18. A sheet feeding apparatus according to claim 17, further comprising fixing means for fixing said separation roller in either position into which said separation roller is switched by said switching means.

19. A sheet feeding apparatus comprising:

sheet supporting means for supporting a stack of sheets;

sheet feeding means, in contact with an upper surface of a sheet at the top of the stack of sheets supported by said sheet supporting means, for feeding said sheet;

an inclined separation plane for separating the sheet fed by said sheet feeding means from the stack of sheets;

a rotatable separation roller, disposed between said inclined separation plane and said sheet feeding means, for pressing the upper surface of the sheet fed by said sheet feeding means; and switching means for switching said separation roller between a position in which said separation roller presses the upper surface of the sheet being fed and a position in which said separation roller is apart from the upper surface of the sheet being fed, wherein said switching means automatically switches the position of said separation roller depending on a rigidity of the sheet which is fed by said sheet feeding means and bent by said inclined separation plane.

20. A sheet feeding apparatus according to claim 19, wherein said switching means automatically switches the position of said separation roller such that said separation roller is in the position apart from the upper surface of the sheet being fed when said sheet has large rigidity and said separation roller is in the position in which said separation roller presses the upper surface of the sheet being fed when said sheet has small rigidity.

21. A sheet feeding apparatus according to claim 20, wherein said switching means includes:

detection means for detecting a load imposed by the bending rigidity of the sheet upon rotatable separation roller, said sheet being fed by said sheet feeding means and bent by said inclined separation plane; and separation roller driving means for moving said rotatable separation roller;

whereby said switching means moves said rotatable separation roller in accordance with the detection performed by said detection means in such a manner that said switching means moves said rotatable separation roller into the position in which said separation roller is apart from the sheet when the load is large, said switching means moves said separation roller into the position in which said separation roller presses the sheet when the load is small.

22. A sheet feeding apparatus according to claim 21, wherein:

said rotatable separation roller is supported by swingable roller supporting means; and said rotatable separation roller driving means swings said roller supporting means thereby selectively moving said rotatable separation roller between the position in which said rotatable separation roller is urged into contact with the sheet and the position in which said separation roller is apart from the sheet.

23. A sheet feeding apparatus according to claim 22, wherein:

said detection means is a load cell for detecting the load imposed upon said separation roller; and said separation roller driving means is a solenoid which is turned on and off in accordance with a detection result provided by said load cell, thereby swinging said roller supporting means.

24. A sheet feeding apparatus according to claim 19, wherein said switching means includes: a belt-shaped member disposed in a rotation transmission path via which rotation is transmitted to said sheet feeding means; and a tension member for applying a tension to said belt-shaped member, said belt-shaped member expanding and contracting depending on a force imposed upon said separation roller, said force arising from a bending rigidity of the sheet which is fed by said sheet feeding means and which is bent by said inclined separation plane, and said tension member being moved in response to the expansion and contraction of said belt-shaped member.

25. A sheet feeding apparatus according to claim 19, wherein:

said inclined separation plane is pivotable; and said sheet feeding apparatus further comprising turning means for turning said inclined separation plane in response to switching of the position of said separation roller in such a manner that said inclined separation plane is in a first position when said separation roller is in the position in which said separation roller is urged into contact with the upper surface of the sheet, and said inclined separation plane is in a second position in which said inclined separation plane has a greater angle with respect to the surface of the sheet tray than a corresponding angle for said first position, when said separation roller is in the position which said separation roller is apart from the upper surface of the sheet.

26. A sheet feeding apparatus according to claim 25, wherein said turning means includes: urging means for urging said pivotable inclined separation plane into either of said first and second positions; and inclined separation plane driving means for moving said inclined separation plane into an other position against the urging force of said urging means.

27. A sheet feeding apparatus according to one of claims 1, 8, 14, and 19, wherein:

the surface of said sheet tray is fixed in position; and said sheet feeding means is formed in a movable fashion such that said sheet feeding means moves downward in response to a reduction in the number of sheets remaining after a sheet is fed.

28. An image forming apparatus comprising:

sheet supporting means for supporting a stack of sheets;

a sheet feed roller, in contact with an upper surface of a sheet at the top of said stack of sheets supported by said sheet supporting means, for feeding said sheet;

an inclined separation plane for separating the sheet fed by said sheet feed roller, from the stack of sheets;

a rotatable separation roller, disposed between said inclined separation plane and said sheet feed roller, for pressing the upper surface of the sheet fed by said sheet feed roller;

roller supporting means for movably supporting said separation roller; and image forming means for forming an image on the sheet separated by said inclined separation plane.

29. An image forming apparatus comprising:

sheet supporting means for supporting a stack of sheets;

a sheet feed roller, in contact with an upper surface of a sheet at the top of said stack of sheets supported by said sheet supporting means, for feeding said sheet;

an inclined separation plane for separating the sheet fed by said sheet feed roller, from the stack of sheets;

rotatable separation roller which is disposed between said inclined separation plane and said sheet feed roller and which is urged against both the upper surface of the sheet and the inclined separation plane;

roller supporting means for supporting said separation roller such that said separation roller is movable in accordance with the rigidity of the sheet being fed; and image forming means for forming an image on the sheet separated by said inclined separation plane.

30. An image forming apparatus comprising:

sheet supporting means for supporting a stack of sheets;

sheet feeding means, in contact with an upper surface of a sheet at the top of a stack of sheets supported by said sheet supporting means, for feeding said sheet;

an inclined separation plane for separating sheets fed by said sheet feeding means, from the stack of sheets;

a rotatable separation roller, disposed between said inclined separation plane and said sheet feeding means, for pressing the upper surface of the sheet fed by said sheet feeding means;

switching means for switching said separation roller between a position in which said separation roller presses the upper surface of the sheet being fed and a position in which said separation roller is apart from the upper surface of the sheet being fed; and image forming means for forming an image on the sheet separated by said inclined separation plane.

31. An image forming apparatus comprising:

sheet supporting means for supporting a stack of sheets;

sheet feeding means, in contact with an upper surface of a sheet at the top of a stack of sheets supported by said sheet supporting means, for feeding said sheet;

an inclined separation plane for separating the sheet fed by said sheet feeding means from the stack of sheets;

a rotatable separation roller, disposed between said inclined separation plane and said sheet feeding means, for pressing the upper surface of the sheet fed by said sheet feeding means;

switching means for switching said separation roller between a position in which said separation roller presses the upper surface of the sheet being fed and a position in which said separation roller is apart from the upper surface of the sheet being fed, wherein said switching means automatically switches the position of said separation roller depending on a rigidity of the sheet which is fed by said sheet feeding means and bent by said inclined separation plane; and image forming means for forming an image on the sheet separated by said inclined separation plane.

* * * * *

UNITED STATES PATENT AND TRADEMARK OFFICE

CERTIFICATE OF CORRECTION

PATENT NO. : 6,375,183 B1
DATED : April 23, 2002
INVENTOR(S) : Ryukichi Inoue et al.

It is certified that error appears in the above-identified patent and that said Letters Patent is hereby corrected as shown below:

Column 2,
Line 14, "form" should read -- from --.

Column 3,
Line 9, "schematic" should read -- a schematic --.
Line 24, "2a for" should be deleted.

Column 4,
Line 43, "are" should read -- is --.

Column 8,
Line 3, "of the" (2nd occurrence) should be deleted.

Column 9,
Line 11, “A119," should read -- (A) 119, --.
Line 11, "B120," should read -- (B) 120, --.
Line 17, "feeding" should read -- feed --.
Line 41, "figure" should be deleted.
Line 58, "one by" should read -- one by one --.

Column 14,
Line 52, "A 128" should read -- (A) 128 --.
Line 66, "is" should be deleted.

Column 19,
Line 18, "embodiment." should read -- embodiments. --.

Column 22,
Line 58, "upon" should read -- upon said --.

UNITED STATES PATENT AND TRADEMARK OFFICE

CERTIFICATE OF CORRECTION

PATENT NO. : 6,375,183 B1
DATED : April 23, 2002
INVENTOR(S) : Ryukichi Inoue et al.

It is certified that error appears in the above-identified patent and that said Letters Patent is hereby corrected as shown below:

Column 23,
Line 58, "an other" should read -- another --.

Signed and Sealed this

First Day of October, 2002

*Attest:*

*Attesting Officer*

JAMES E. ROGAN
*Director of the United States Patent and Trademark Office*